US010974126B2

(12) United States Patent
Keohane et al.

(10) Patent No.: US 10,974,126 B2
(45) Date of Patent: Apr. 13, 2021

(54) SKI STRAP ASSEMBLY AND HANGING DEVICE FOR SKI STRAP

(71) Applicant: Skiezy Inc., Calgary (CA)

(72) Inventors: Edmund Mark Keohane, Edmonton (CA); Mark Kline, Invermere (CA)

(73) Assignee: Skiezy Inc., Edmonton (CA)

( * ) Notice: Subject to any disclaimer, the term of this patent is extended or adjusted under 35 U.S.C. 154(b) by 0 days.

(21) Appl. No.: 16/572,319

(22) Filed: Sep. 16, 2019

(65) Prior Publication Data

US 2020/0078660 A1 Mar. 12, 2020

Related U.S. Application Data

(63) Continuation of application No. PCT/CA2018/050327, filed on Mar. 16, 2018.

(60) Provisional application No. 62/472,142, filed on Mar. 16, 2017.

(51) Int. Cl.
*A63C 11/02* (2006.01)

(52) U.S. Cl.
CPC ..... *A63C 11/021* (2013.01); *A63C 11/025* (2013.01)

(58) Field of Classification Search
CPC ..... A63C 11/021; A63C 11/025
See application file for complete search history.

(56) References Cited

U.S. PATENT DOCUMENTS 3,558,024 A * 1/1971 Walsh ..... A63C 11/025 294/163
3,737,956 A * 6/1973 Gragert ..... A63C 11/025 280/814
3,780,920 A * 12/1973 Green ..... A63C 11/025 294/152
3,935,977 A * 2/1976 Bonnett ..... A63C 11/025 294/147
3,990,655 A * 11/1976 Covell ..... A63C 11/009 294/147
4,043,493 A * 8/1977 Camelio ..... A63C 11/025 294/165
4,134,182 A * 1/1979 Ramsby ..... A63C 11/025 280/814

(Continued)

FOREIGN PATENT DOCUMENTS

EP 1679100 A1 7/2006
GB 201413029 1/2016

(Continued)

OTHER PUBLICATIONS

Ulicny, K; International Search Report from PCT Application No. PCT/CA2018/050327; search completed May 25, 2018.

(Continued)

*Primary Examiner* — Bryan A Evans
(74) *Attorney, Agent, or Firm* — CPST Intellectual Property Inc.; Brett J. Slaney

(57) ABSTRACT

The following describes an assembly for a ski strap. The assembly comprises a first portion comprising a first outer block, a first inner tab extending from the first outer block, a first retaining mechanism for a strap. The assembly also comprises a second portion comprising a second outer block, a second inner tab extending from the second outer block, and a second retaining mechanism for the strap. A ski strap assembly is also provided that comprises a ski strap and the assembly.

20 Claims, 30 Drawing Sheets

(56) References Cited

U.S. PATENT DOCUMENTS

| | | | | | |
|---|---|---|---|---|---|
| 4,221,314 | A * | 9/1980 | Baker, Jr. | A63C 11/025 | 24/302 |
| 4,269,435 | A * | 5/1981 | Jarvenkyla | A63C 11/025 | 280/814 |
| 4,460,207 | A * | 7/1984 | Gies | A63C 11/025 | 294/147 |
| 4,470,528 | A * | 9/1984 | Dyess | A63C 11/025 | 224/257 |
| 4,536,926 | A * | 8/1985 | Pantaleo | A63C 11/021 | 211/70.5 |
| 4,588,115 | A * | 5/1986 | Uyeda | A63C 11/025 | 224/218 |
| 4,620,722 | A * | 11/1986 | Dunn | A63C 11/025 | 224/917 |
| 4,729,591 | A * | 3/1988 | Scalise | A63C 11/025 | 224/578 |
| 4,786,097 | A * | 11/1988 | Howard | A63C 11/025 | 280/814 |
| 4,842,315 | A * | 6/1989 | Nordmeyer | A63C 11/025 | 294/143 |
| 4,852,931 | A * | 8/1989 | Ferdi | A63C 11/025 | 294/147 |
| 4,871,102 | A * | 10/1989 | Wickersham | A63C 11/025 | 224/191 |
| 4,878,274 | A | 11/1989 | Patricy | | |
| 2002/0144963 | A1 | 10/2002 | Mood | | |
| 2002/0190169 | A1 | 12/2002 | Dettorre | | |
| 2007/0170130 | A1 * | 7/2007 | Plzak | B25H 3/04 | 211/70.6 |
| 2011/0062295 | A1 | 3/2011 | Totman | | |
| 2012/0181782 | A1 * | 7/2012 | Valaas | A63C 11/021 | 280/814 |
| 2012/0305722 | A1 | 12/2012 | Krosky | | |
| 2018/0193719 | A1 * | 7/2018 | Reid | A45F 5/021 | |

FOREIGN PATENT DOCUMENTS

| | | | |
|---|---|---|---|
| WO | 02100219 | A2 | 12/2002 |
| WO | 2011101220 | A1 | 8/2011 |
| WO | 2016012744 | A1 | 1/2016 |
| WO | 2017/091906 | A1 | 6/2017 |
| WO | 2017091906 | A1 | 6/2017 |
| WO | PCT/CA2018/050327 | | 3/2018 |

OTHER PUBLICATIONS

Ulicny, K; International Search Report from PCT Application No. PCT/CA2016/051422; search completed Feb. 10, 2017.

European Search Report issued in corresponding EP application No. 18768639.9; search completed on Nov. 25, 2020.

Anonymous: "Voile Straps: Voile", Nov. 2, 1990 (Nov. 2, 1990), XP055753967, retrieved from the Internet URL: https://www.voile.com/voile-straps.html (retrieved on Nov. 25, 2020).

* cited by examiner

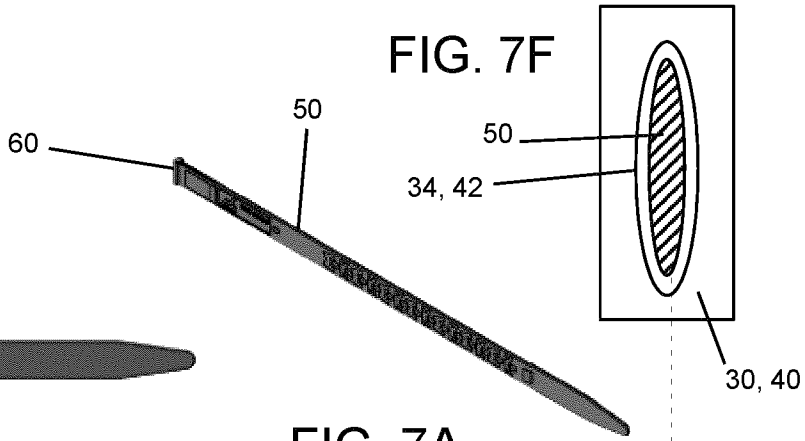
FIG. 7F
FIG. 7A
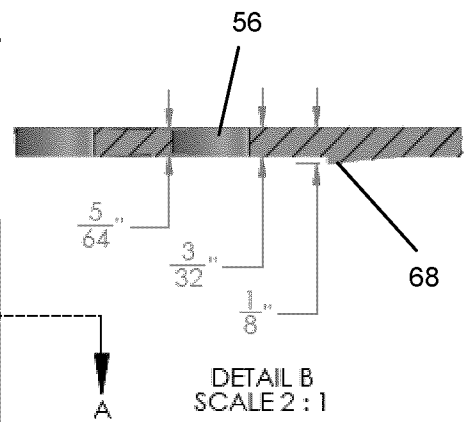
FIG. 7E
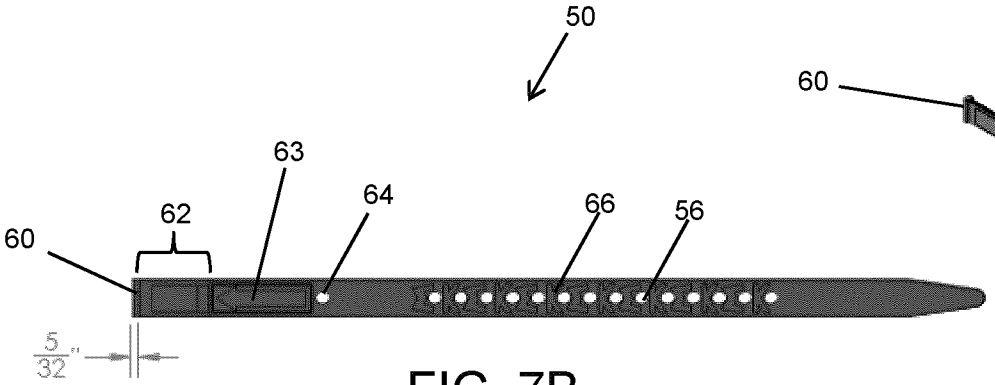
FIG. 7B
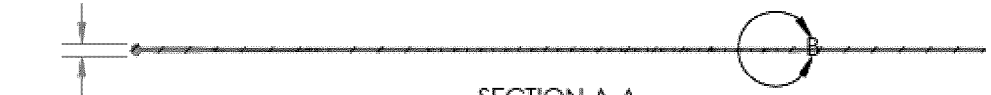
FIG. 7C
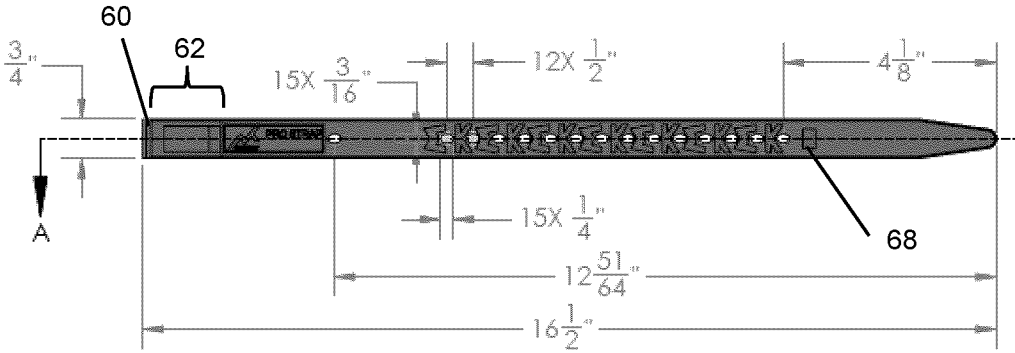
FIG. 7D

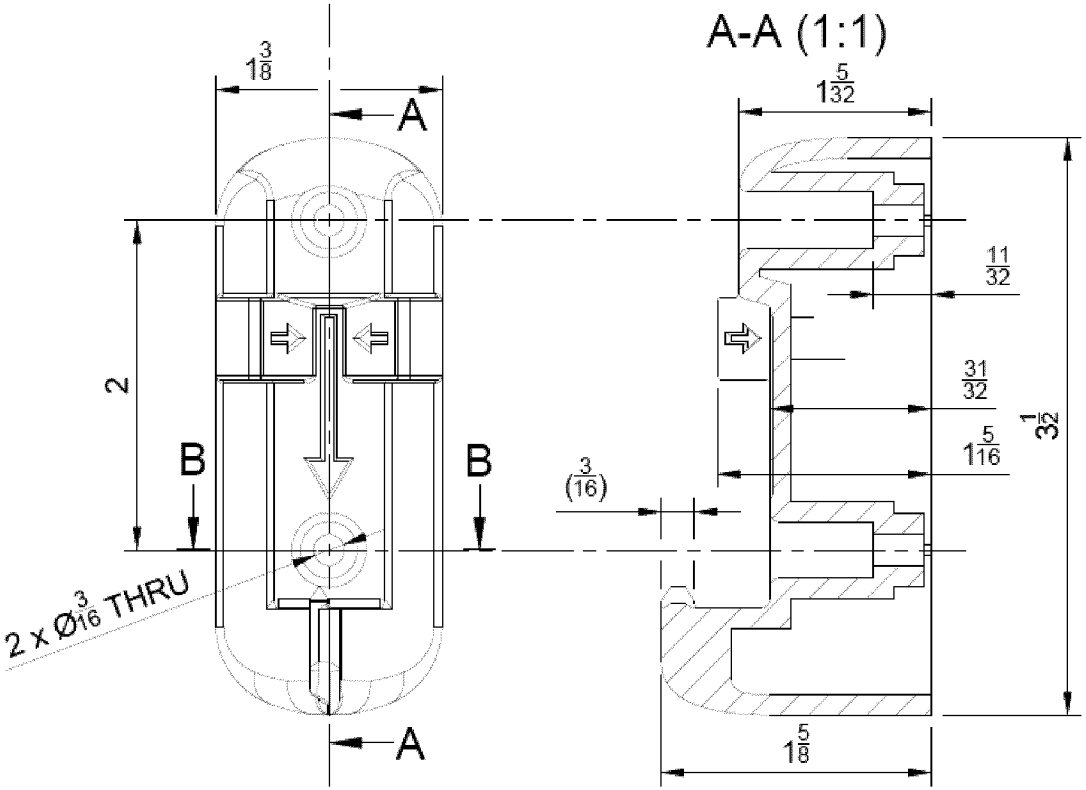
FIG. 34
FIG. 33
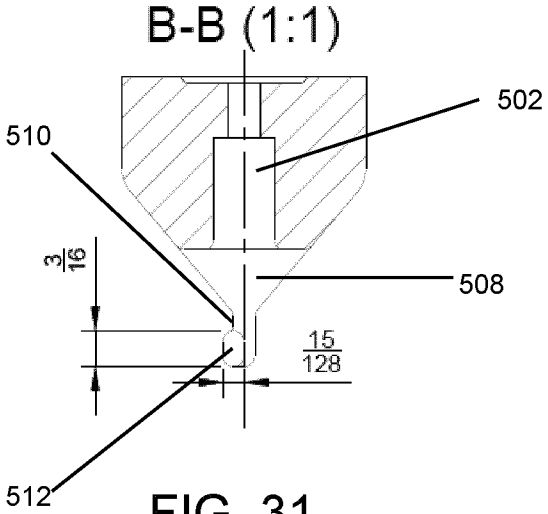
FIG. 31
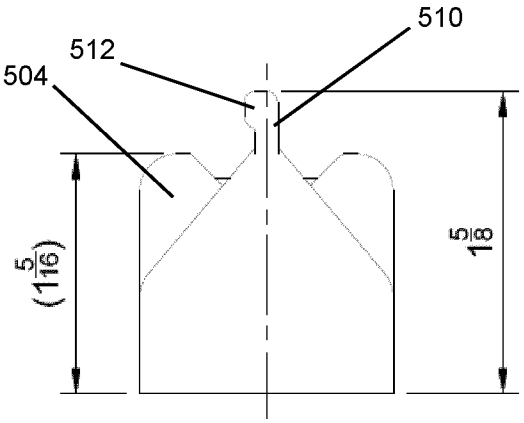
FIG. 32

SKI STRAP ASSEMBLY AND HANGING DEVICE FOR SKI STRAP

CROSS-REFERENCE TO RELATED APPLICATION(S)

This application is a continuation of PCT Application No. PCT/CA2018/050327 filed on Mar. 16, 2018, which claims priority to U.S. Provisional Patent Application No. 62/472,142 filed on Mar. 16, 2017, both incorporated herein by reference in their entirety.

TECHNICAL FIELD

The following relates to ski strap assemblies and hanging devices to be used with ski straps for hanging skis.

DESCRIPTION OF THE RELATED ART

Ski straps are routinely used to secure a pair of skis together to assist in transporting the pair of skis when not in use. Ski straps normally include a protective tab at the end of the strap that is inserted between the skis, and the remaining portion of the strap wraps around the skis and is secured to itself to effectively combine a pair of items into a single item for transportation purposes.

Other ski straps exist that do not include a protective tab, but which simply wrap around a pair of skis and are tightened using a buckle. An example of such ski straps are the Voile Straps® produced by Voile Manufacturing. These types of ski straps are often favored by back country skiers, where contact between the tuned surfaces and edges of the skis is not normally a paramount concern. The tuned surfaces are, however, placed against each other trapping moisture and debris against the surfaces, which is undesirable to at least some skiers.

Moreover, while a ski strap is useful for transporting, it does not address issues related to storing the skis. To organize the storage of the skis, even when secured using a ski strap, typically requires careful placement or a separate rack or other structure to organize and protect the skis.

SUMMARY

In one aspect, there is provided an assembly for a ski strap comprising: a first portion comprising a first outer block, a first inner tab extending from the first outer block, a first retaining mechanism for a strap; and a second portion comprising a second outer block, a second inner tab extending from the second outer block, and a second retaining mechanism for the strap.

In another aspect, there is provided a hanging device for skis, comprising: a first portion comprising a first outer block, a first inner tab extending from the first outer block, a first retaining mechanism for a strap, and a hanging mechanism extending in a direction opposite that of the first inner tab, for hanging the pair of skis when secured by the strap; and a second portion comprising a second outer block, a second inner tab extending from the second outer block, and a second retaining mechanism for the strap.

In yet another aspect, there is provided a ski strap assembly comprising a ski strap, and the hanging device described above. The strap can include a length of material and a buckle to secure the strap around the skis using the ski strap assembly.

In yet another aspect, there is provided a strap comprising a length, the length comprising a plurality of holes therealong; and a moveable tooth or button structure to be secured to the strap using one of the plurality of holes to enable the tooth or button to be placed at a plurality of positions along the strap.

BRIEF DESCRIPTION OF THE DRAWINGS

Embodiments will now be described by way of example only with reference to the appended drawings wherein:

FIGS. 7A to 7F illustrate further detail for a strap to be used with a ski strap assembly and/or ski strap and hanging device;

FIG. 31 is a top cross-sectional view of the hanging mechanism of FIG. 29 along the line B-B shown in FIG. 33;

FIG. 32 is a bottom view of the hanging mechanism of FIG. 29;

FIG. 33 is a front view of the hanging mechanism of FIG. 29;

FIG. 34 is a side cross-sectional view of the hanging mechanism of FIG. 29;

DETAILED DESCRIPTION

Figure 1:
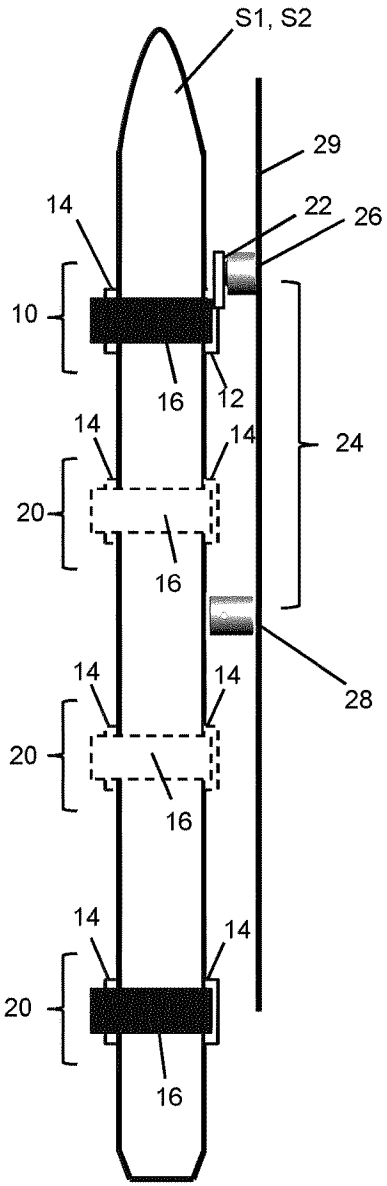
FIG. 1 is a side view of a pair of skis held by a plurality of ski straps, one of which includes a hanging device, and a hanging mechanism used therewith.

Turning now to the figures, FIG. 1 illustrates a combined ski strap and hanging device 10 (the "device 10" hereinafter). The device 10 includes a first portion 12 and a second portion 14 secured at opposite sides of a pair of skis S1, S2 using a strap 16. The first portion 12 includes a hanging loop 22 or other hanging support member or mechanism (e.g. a D-ring) that is used to hang the skis S1, S2 on a hanging mechanism 24 or other suitable hook, peg, post, nail, protrusion, magnet, buckle, Velcro, etc.

The hanging mechanism 24 illustrated in FIG. 1 includes an upper post 26 and a lower post 28, details of which are provided below. The posts 26, 28 are secured to a wall 29 or other substrate (e.g., the side of a shelving unit or other piece of furniture). The upper post 26 includes a lip onto which the loop 22 hangs, and the lower post 28 act as a protrusion or bumper that extends outwardly from the wall 29 to maintain a separation between the skis S1, S2 and the wall 29. In this way, not only can the skis S1, S2 be hung on the wall, the lower post 28 inhibits damage to finished walls (e.g., to avoid paint and drywall chips, dents, etc.) when supporting the skis S1, S2. It has also been found that supporting the skis S1, S2 in this way also improves the aesthetic appeal of the overall solution. It has been found that a separation of twelve inches or more between the posts 26, 28 is preferred to avoid misalignment of the hanging device 10 on the upper post 26 and provides a substantially plumb orientation with respect to the wall 29. This separation between the posts 26, 28 can also inhibit the skis S1, S2 from rotating towards or away from the wall 29.

In general, the loop 22 is oriented such that a generally vertically oriented member can pass therethrough and/or engage therewith, enabling the loop 22 to be supported on various structures, such as the upper post 26 shown in FIG. 1, as well as a portion of a hook, etc. as noted above. That is, in this example, the opening provided in the loop 22 is oriented orthogonal to a plane defined by the skis S1, S2, to orient the skis S1, S2 in an upright manner.

In addition to using a hanging mechanism 24 secured to a wall, the device 10 can also be hung on hooks, pegs or other members provided on a ski rack or other free-standing structures such as shelving units and the like (not shown). Therefore, the device 10 does not necessarily need to be used with a wall-mounted structure. Moreover, existing ski racks (or other structures) can be retrofitted to include hooks (or the hanging mechanism 26) such that the structure can be used with the device 10 as herein described.

A pair of second portions 14 can also be used with another strap 16 to provide one or more secondary devices 20 (also referred to herein as a non-hanging device 20 or assembly for a ski strap) that do not require a hanging device such as that provided with the first portion 12. It can be seen in FIG. 1 that a plurality of additional secondary devices 20 can be used to secure the skis S1, S2 to each other. It can also be appreciated that a pair of second portions 14 and a strap can be used on its own, without any hanging device, e.g., to replace a conventional ski strap.

Figure 2:
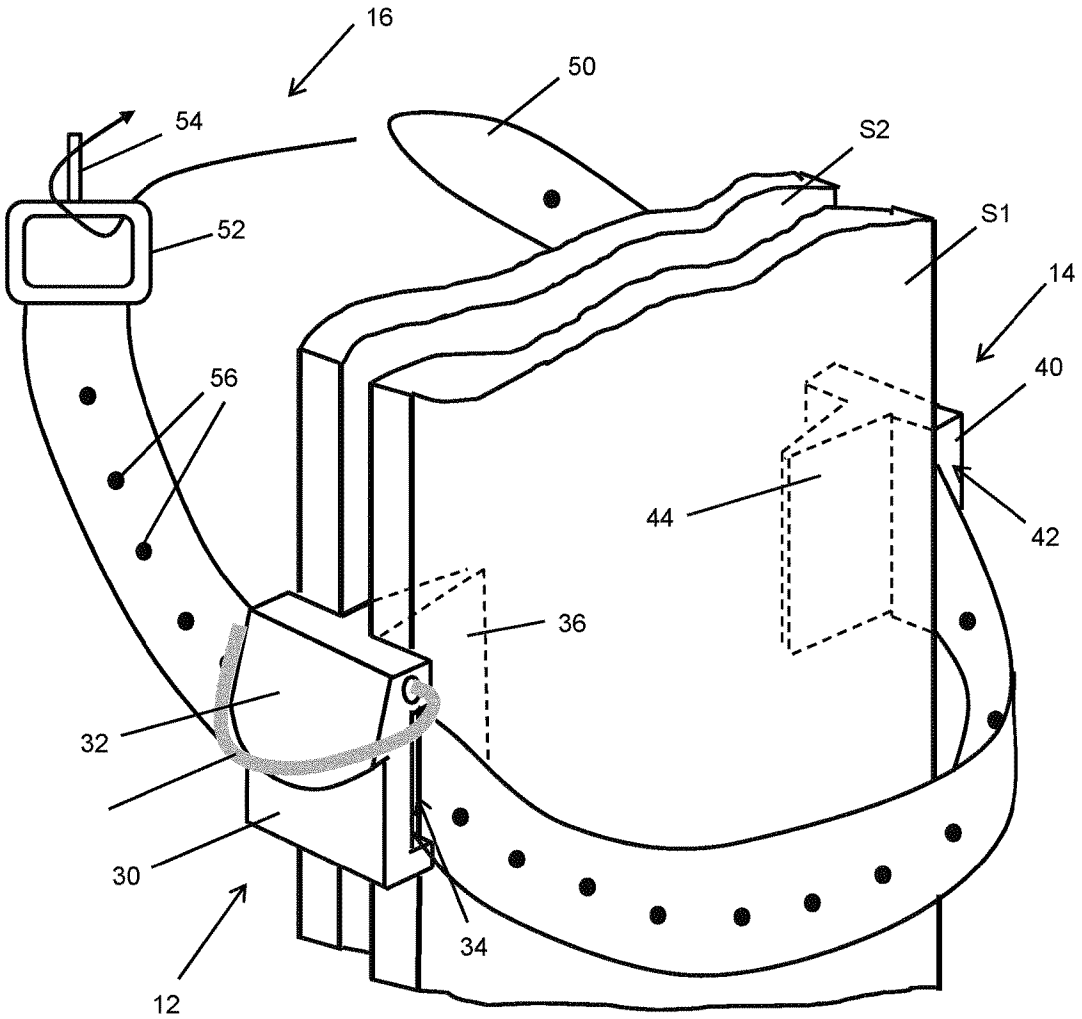
FIG. 2 is a perspective view of a ski strap and hanging device.

Various types of straps 16 can be used, for example a Voile-type strap as shown in FIG. 2. Turning now to FIG. 2, the first and second portions 12, 14 are shown in greater detail. The first portion 12 is generally "T" shaped, and includes a first outer block 30 with a lip 32 securing the loop 22 thereto for storage, shipping, transport, etc. The first outer block 30 includes a first slot 34 that permits passage of the strap 16. That is, the first slot 34 is positioned in the first outer block 30, which abuts the edges of the skis S1, S2, such that it is external to the skis S1, S2, and guides the strap 16 around the skis S1, S2 to secure them together. The first portion 12 also includes a tapered first inner tab 36 that extends perpendicularly from the first outer block 30 such that it is secured between the skis S1, S2, but only a portion thereof actually touches the skis S1, S2 namely at the edges as discussed below. The tab 36 is seen in dashed lines in FIG. 2. The first inner tab 36 also provides a separation between the skis S1, S2 that is equivalent to the thickness of the base of the first inner tab 36 where it connects to the first outer block 30. By having a tapered first inner tab 36, the amount of contact with the "tuned" surfaces of the skis S1, S2 can be minimized to only contact with the edges when the strap 16 is secured. This can be particularly advantageous when the devices 10, 20 are used with racing skis where the quality of the surfaces and edges that engage the underlying terrain are paramount to racers. The spacing between the skis S1, S2 also allows air to flow over the underlying surfaces of the skis S1, S2 thus reducing or eliminating moisture build up, oxidization, accumulation of debris, etc.

The second portion 14 is also shown primarily in dashed lines in FIG. 2. The second portion 14 includes a second outer block 40 having a second slot 42 that is similar to the first slot 34 in the first outer block 30 of the first portion 12. The second outer block 40 abuts the edges of the skis S1, S2 such that it is external to the skis S1, S2, and guides the strap 16 around the skis S1, S2 to secure them together, when the strap 16 is fed through both the first and second portions 12, 14. The second portion 14 also includes a tapered second inner tab 44 that extends perpendicularly from the second outer block 40 and towards the first outer block 30 (i.e. in a direction that is opposite that of the first inner tab 36), such that it is interposed between the skis S1, S2 in a manner similar to that described above with respect to the first tab 12. To maintain a consistent separation, the thickness of the base of the second inner tab 44 should be substantially the same or identical to the thickness of the first inner tab 36, since the second inner tab 44 also provides a separation between the skis S1, S2 that is equivalent to the thickness thereof. Again, by having a tapered second inner tab 44, the amount of contact with the "tuned" surfaces of the skis S1, S2 can be minimized to only contacting the edges.

FIG. 2 also shows a strap 16 that is fed through the first and second slots 34, 42 prior to being secured in place. It can be appreciated that the first and second slots 34, 42 are not necessarily required. For example, one could configure the first and second portions 12, 14 to have outwardly facing (and open) channels with upper and lower ridges (not shown) to maintain positioning of the strap 16. However, using slots 34, 42 as shown in FIG. 2 facilitates keeping the strap 16 and first and second portions 12, 14 together, e.g., for storage and transportation.

The strap 16 shown in FIG. 2 is a Voile-type strap 16 have a rubberized length 50 extending from a nylon buckle 52. The length 50 is attached at one end to the buckle 52 and has a free end that can be fed through the slots 34, 42. The free end is also fed through the buckle 52 and pulled back towards the second portion 14 to cinch the length 50 around the skis S1, S2 while pulling the tabs 36, 44 of the first and second portions 12, 14 towards each other. The buckle 52 enables slack to be removed from the length 50 of the strap 16 to enable easier tightening. The buckle 52 can be made from a plastic or a metal or any other suitable material that can withstand the forces imparted on the buckle 52 when the strap 16 is looped therethrough, e.g., nylon. Similarly, the loop 22 can be implemented using a metal ring such as a D-ring, or can be made from a fabric, plastic, string/rope or any other material, e.g., nylon, that enables the loop 22 to be formed or affixed to the first outer block 30 while being able to support the weight of a typical pair of skis S1, S2.

The length 50 of the strap 16 can include a taper as shown in FIG. 2, and may include various thicknesses depending on the material used, and lengths to accommodate different ski-widths. As such, it can be appreciated that there are various configurations and materials that can be used within the scope of the principles described herein.

Figure 3A:
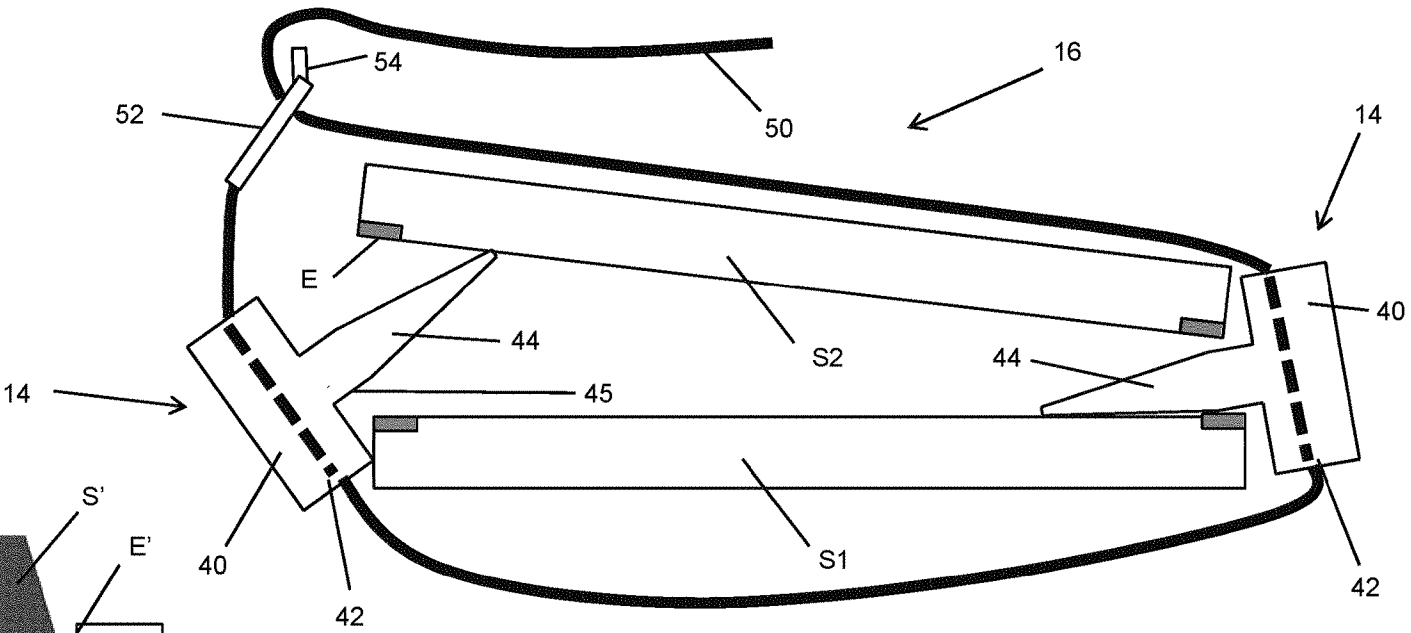
FIG. 3A is a schematic plan view of a ski strap with a pair of end portions being used to secure a pair of skis.

To secure the length 50 in place, it is pulled over a tooth 54 until desirably tight, with the tooth 54 being aligned and fed through one of a series of holes 56 in the length 50. As illustrated in FIG. 3A, the tooth 54 is angled relative to a plane defined by the buckle 50 such that pulling a particular hole 56 in the length along the tooth 54 until the length 50 is in tension (and partially stretched depending on the material used) ensures that the resilience of the length 50 pulls the tooth 54 through the hole 56 to secure the strap 16, first portion 12, and second portion 14 together. It can be appreciated that the Voile-type strap 16 shown in FIG. 2 can therefore be used in the same way as a Voile-type strap 16 is normally used. However, by feeding the strap 16 through the first and second portions 12, 14, the aforementioned separation between the skis S1, S2 is achieved. Moreover, by including the first portion 12 in assembling device 10, the strap 16 is incorporated into a hanging device for hanging the skis S1, S2. By feeding the length 50 through the buckle 52 in this way, the strap 16 can accommodate different widths and sizes of skis S1, S2.

Figure 3B:
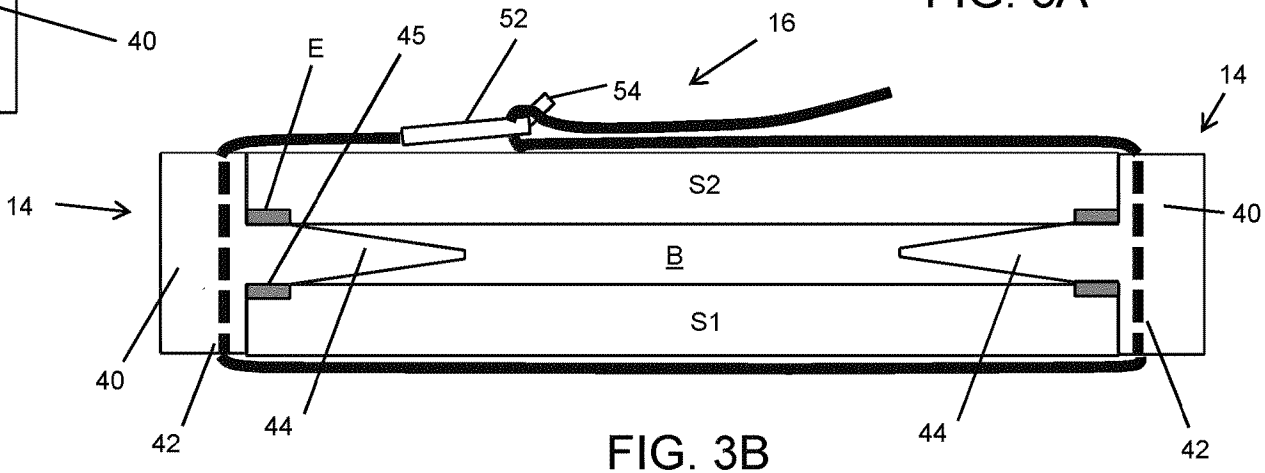
FIG. 3B is a schematic plan view of a pair of skis secured using a ski strap having a pair of end portions.
Figure 3C:
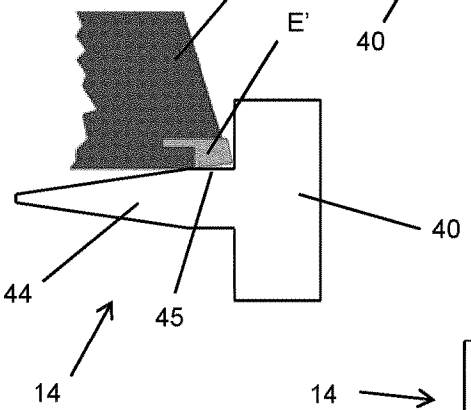
FIG. 3C illustrates an end portion adjacent a beveled ski edge.

FIGS. 3A, 3B, 3C, 3D, and 3E provide additional detail regarding the separation maintained between the skis S1, S2 when the devices 10, 20 are assembled. In FIG. 3A, a pair of second portions 14 are shown during assembly of the device 20. As can be seen in FIG. 3A, the second inner tab 44 includes a perpendicular base portion 45 that extends from the block 40 before the tab 44 begins to taper. While the tapered tab 44 minimizes contact with the skis S1, S2, as shown in FIG. 3A, its length facilitates assembly by maintaining alignment of the tab 44 between the skis S1, S2 even when rotated as the strap 16 is being fed through the portions 14. That is, the length of the tabs 44 inhibits the portions 14 from slipping out of position during assembly. As illustrated in FIG. 3A, the length 50 of the strap 16 is fed through the slots 42 of the two second portions 14, through the buckle 52 and turned back such that it can be secured over the tooth 54 as shown in FIG. 3B. In FIG. 3B it can be observed that the portions 14 only contact the skis S1, S2 at the edges E due to the tapering of the tabs 44, thus maximizing the void B between the skis S1,S2. FIG. 3C illustrates an angled edge E' that would also be suitably seated against the perpendicular portion 45 and part of the block 40.

Figure 3E:
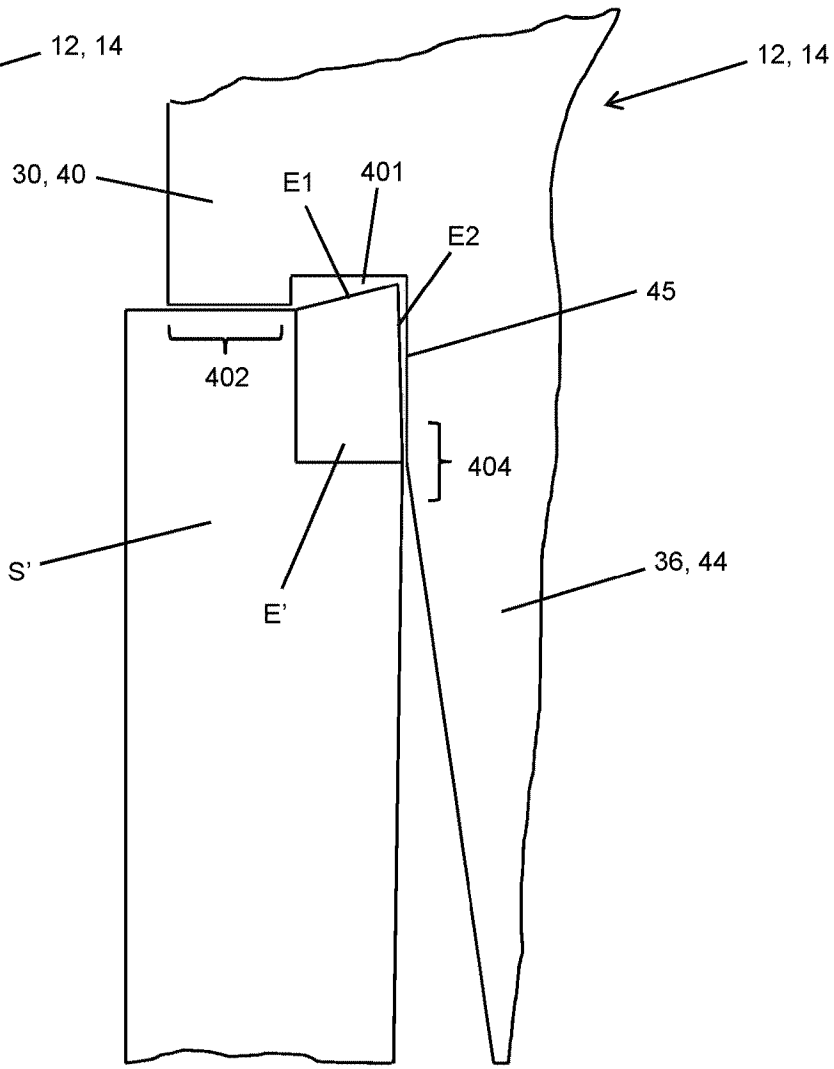
FIG. 3E illustrates an alternative recessed area in the first or second portion of the ski strap to accommodate a beveled ski edge.
Figure 3D:
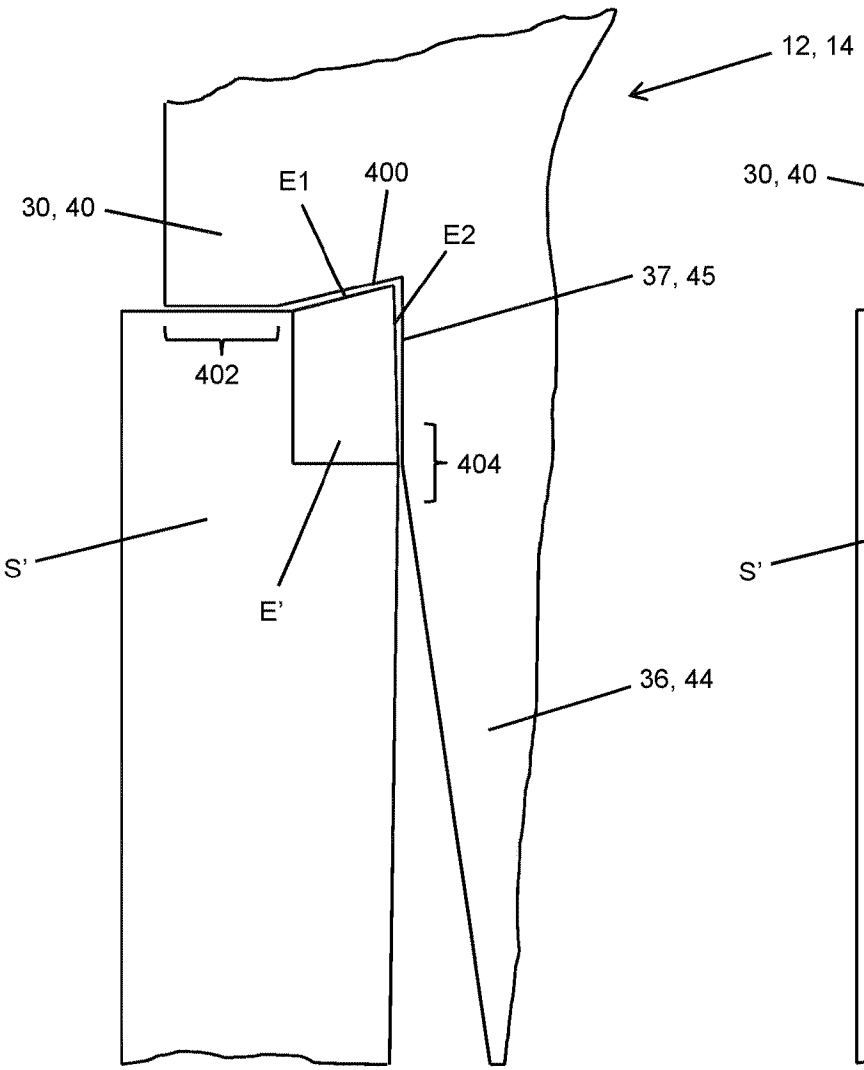
FIG. 3D illustrates a recessed area in the first or second portion of the ski strap to accommodate a beveled ski edge.

In an alternative configuration, shown in FIGS. 3D and 3E, the amount of the edge E' that comes into contact with the first or second portion 12, 14 can be minimized by incorporating a recessed area 400, 401 into a portion of the block 30, 40 that is adjacent the perpendicular base 37, 45. Referring first to FIG. 3D, in this example the recessed area 400 is created by introducing a bevel into the block 30, 40 that has an angle similar to or greater than the bevel typically included on the sidewall edge E1 of the ski S' (e.g., up to 4 degrees in some cases). By beginning the beveled recessed area 400 at a point that is higher than the sidewall edge E1 (i.e. at or before the top of edge E'), only a sidewall portion 402 of the ski S' comes into contact with the block 30, 40, rather than the sidewall edge E1. As can also be seen in FIG. 3D, the base edge E2 of the ski S' may also have a beveled edge E2 (e.g., about 0.5-1 degree), which has a minimal contact area 404 with the perpendicular base 37, 45. In this way, it can be seen that not only is contact with the base of the ski S' minimized or avoided altogether, contact between the edges E1, E2 and the portion 12, 14 is minimized to a small area 404, with the remaining contact being between the sidewall of the ski S' and the block 30, 40 at the sidewall portion 402.

Turning next to FIG. 3E, it can be appreciated that the recessed area 400, 401 can instead be provided using a notched portion, denoted by numeral 401 in FIG. 3E. By beginning the notch at a point that is higher than the sidewall edge E1, similar to the alternative shown in FIG. 3D, only the sidewall portion 402 of the ski S' comes into contact with the block 30, 40. The depth of the notched recessed area 401 can be chosen to accommodate various expected beveled sidewall edges E1 that may protrude to different extents (e.g., up to 4 degrees). While FIGS. 3D and 3E illustrate beveled and notch-shaped recessed areas 400, 401, it can be appreciated that any suitable shape or contour can be used, e.g. a curve or divot, etc. Moreover, although apparent from FIGS. 3D and 3E, for greater certainty, it can be appreciated that the recessed areas 400, 401 (or variations thereof) can be applied to both sides of the tabs 36, 44 on either or both the first portion 12 (with hanging device) or second portion 14 (without hanging device).

As illustrated in FIGS. 3A-3E and discussed above, edges E, E' of the skis S1, S2 (each comprising sidewall edges E1 and base edges E2) will typically come into contact with the first and second portions 12, 14. For example, in FIG. 3C, both the sidewall edge E1 and base edge E2 would at least partially contact the block 40 and tab 44, and in FIGS. 3D and 3E, at least a portion of the base edge E2 would contact the block 30, 40. In an implementation, to avoid potential galvanic corrosion between the metal in the edges E, E' and the first and second portions 12, 14 (e.g., caused by a "battery" effect between metallic materials), the material used to form these portions 12, 14 can be selected to be electrically inert, i.e. without any metallic portion in their composition. For example, while a carbon fiber material is known to be strong and durable, an alternative material such as a glass-filled nylon material could be selected to obviate the potential for galvanic corrosion, which is similarly durable and strong but electrically inert. It can be appreciated that while an inert material may, in some implementations be considered an advantageous option, other materials, including carbon fiber should still be considered suitable alternatives in at least some other implementations and the principles discussed herein should not be limited to any particular material.

Figure 4A:
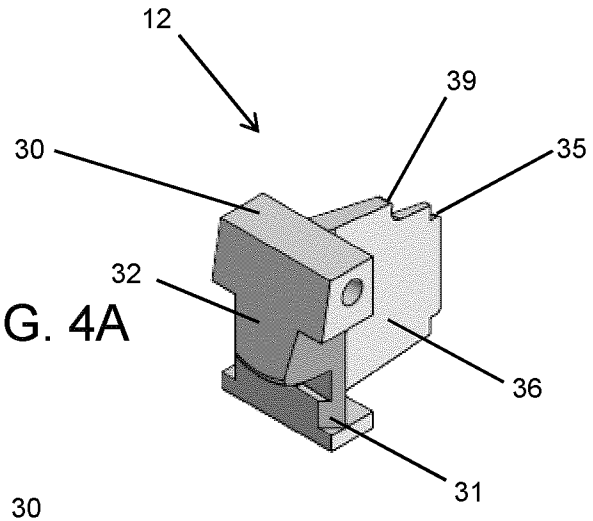
FIGS. 4A to 4D illustrate further detail of a first portion for a ski strap and hanging device having a hanging loop.
Figure 4D:
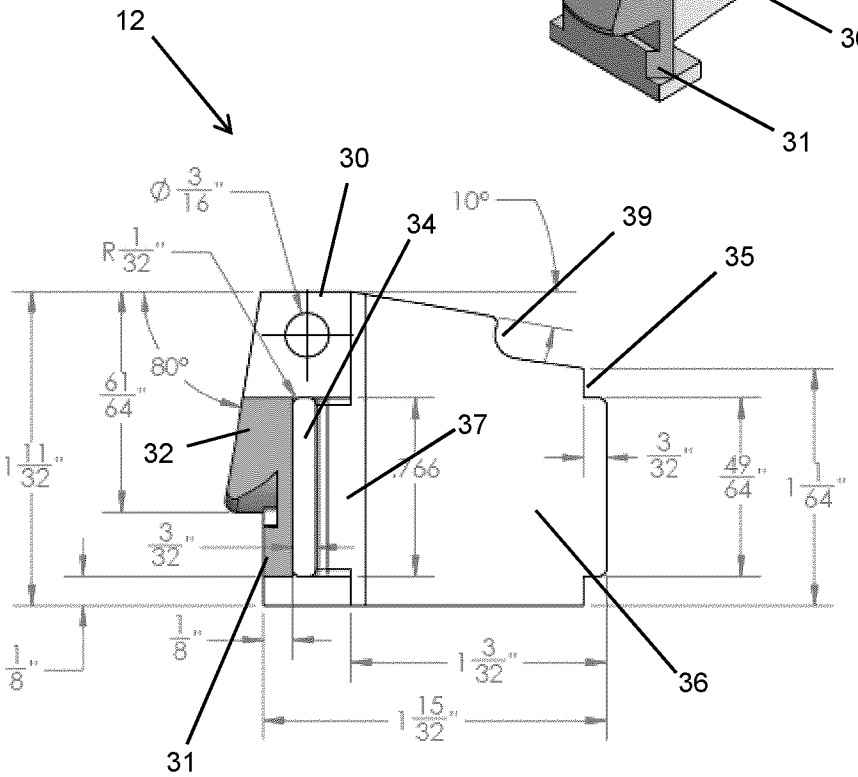

FIGS. 4A-D illustrate further detail for the first portion 12. The lip 32 protrudes at an angle from first outer block 32 and provides an edge over which the loop 22 can be placed for storing the loop 22 against the first outer block 30. The tapered first tab 36, in addition to have a perpendicular base 37 that is substantially similar in length to the width of a typical ski edge E, is contoured to include additional functionality. For example, as seen in FIGS. 4A and 4D, the tab 36 slopes downwardly along it upper edge towards a depression 39 that is substantially similar in size to the cross-sectional shape of the loop 22. This allows the loop 22 to be stored along the top of the first portion 12 when not in use (e.g., see also FIG. 6). The tab 36 also includes upper and lower notches 35 to permit the tab 36 to be coupled to the second portion 14 in an interference fit, as explained later. The block 30 also includes sloped edges 31 on either side of the lip 32 to facilitate additional length 50 of the strap 16 to be wrapped around the front of the first portion 12 without imposing a sharp edge against the length 50. Also shown in FIG. 4D is a side view of the slot 34. The slot 34 can be rounded to match a contour used for the length 50 of the strap 16 to thus require a particular strap 16 to be used with the first portion 12, e.g., when replacements are needed.

Figure 4B:
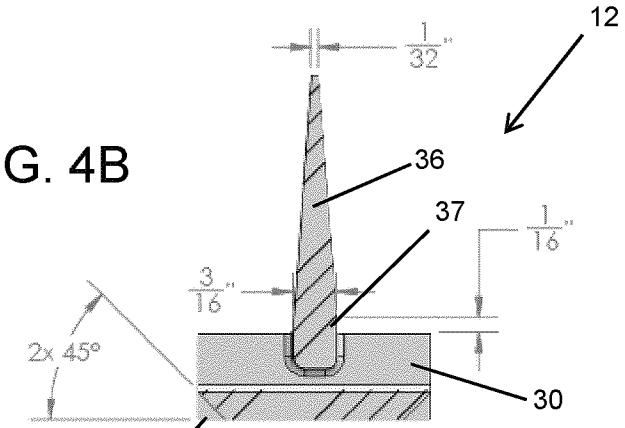
Figure 4C:
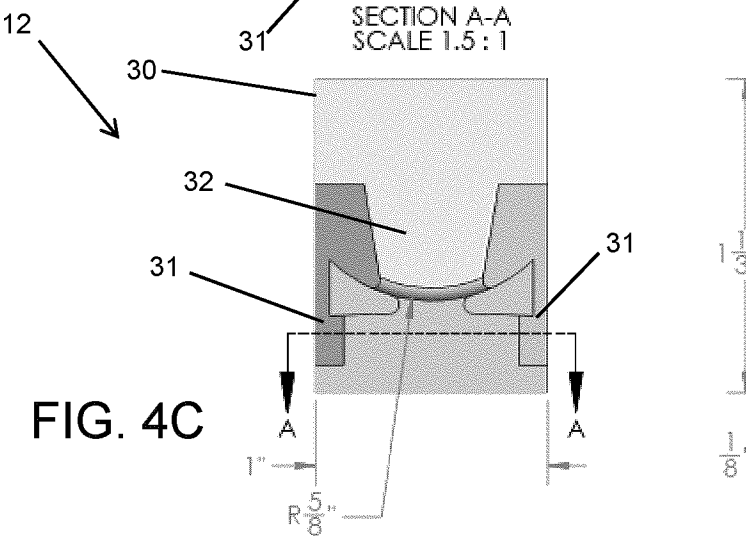

FIG. 4B shows one example in which the width of the tab 36 is 3/16". FIG. 4E shows an alternative size with a tab 36' having a ¼" width. The larger width provides additional separation between the skis S1, S2, and imposes a sharper angle to the taper (assuming the same length of tab 36). As noted above, the notches 35 allow the tab 36 to fit into the block 40 of a second portion 14 by way of an interference fit. Similarly, a tab 44 of the second portion 14 can fit into the block 30 of the first portion 12. More specifically, the outer block 30 in this example is cutaway to define upper and lower flanges between which the notched end of a tab 42 can fit. Detail of this coupling between the first and second portions 12, 14 is provided below. It can be appreciated that notches 35' in the block 30 can be provided instead of using notches 35 in the tab 36 to permit the first and second portions 12, 14 to be coupled to each other. Similarly, as shown in FIGS. 4H and 4I, the notches 35' can be used in conjunction with the recessed area 400, 401 (400 shown in FIGS. 4H and 4I) to provide both storage (FIG. 4H) and in-use (FIG. 4I) configurations.

Figure 4G:
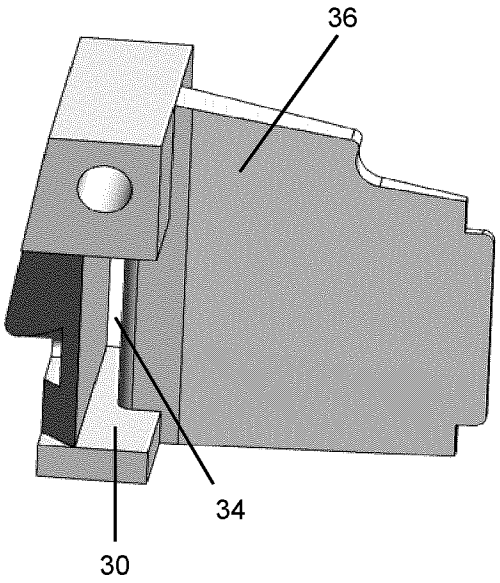
FIG. 4G is a perspective view of the first portion.
Figure 4E:
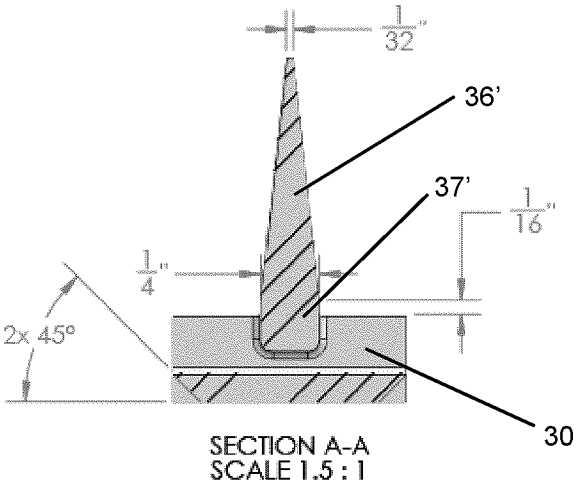
FIG. 4E is a plan view similar to FIG. 4A with alternative exemplary dimensions.
Figure 4F:
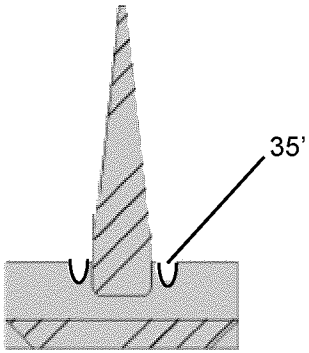
FIG. 4F is a plan view similar to FIGS. 4A and 4E with notches for securing the first portion to a second portion of the ski strap and hanging device.
Figure 4I:
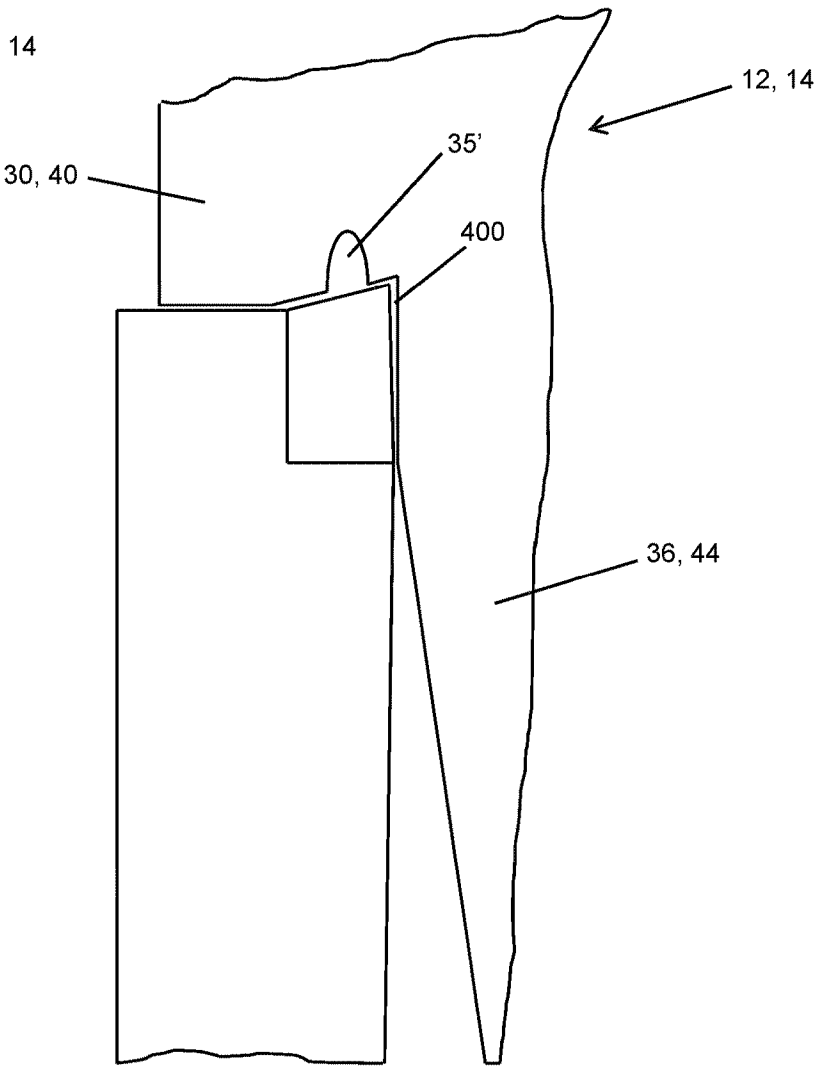
FIG. 4I illustrates the alternative shown in FIG. 4H, with a beveled ski edge adjacent thereto.
Figure 4H:
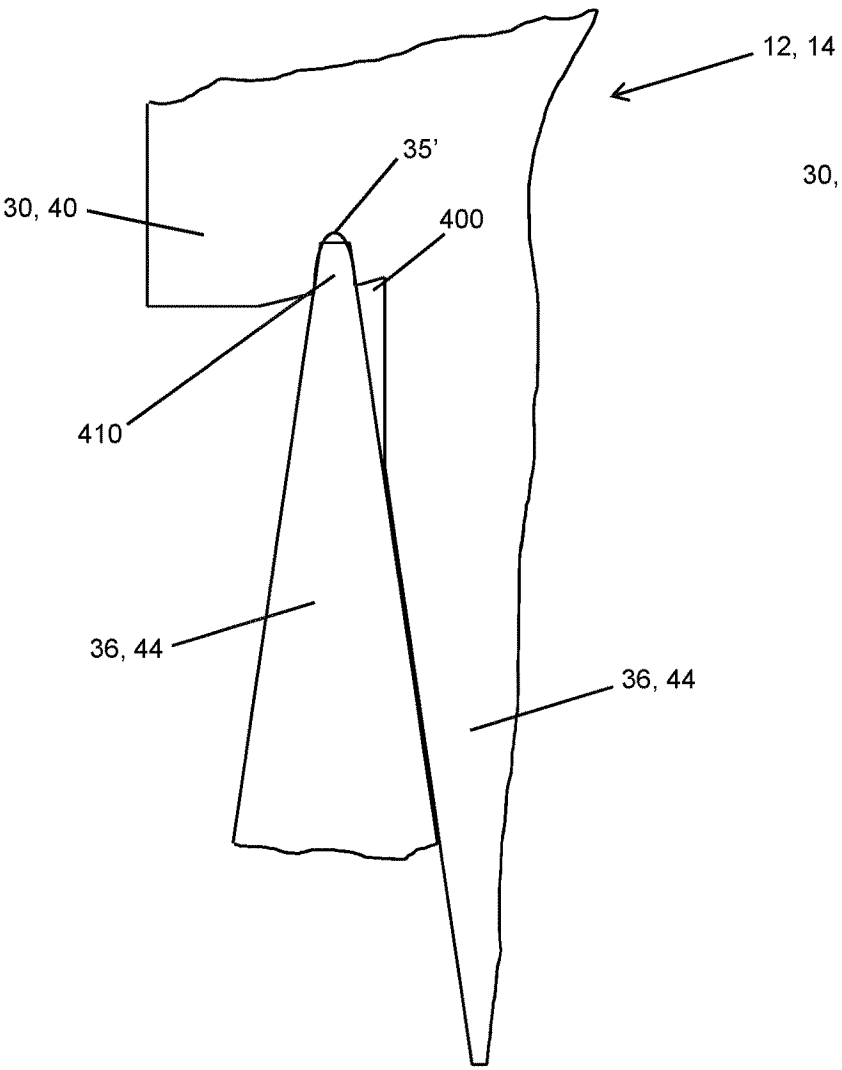
FIG. 4H illustrates an alternative in which the notches shown in FIG. 4F are combined with the recessed area shown in FIG. 3D when securing two portions of the ski strap together.

FIG. 4G shows the cutaway portions of the outer block 30. In addition to enabling an interference fit between the first and second portions 12, 14, the cutaway portions also increase the amount of contact between the length 50 of the strap 16 and the skis S1, S2, regardless of the thickness of the skis S1, S2.

Figure 5A:
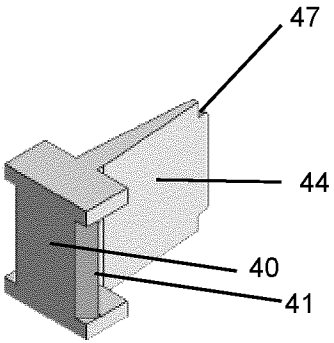
FIGS. 5A to 5E illustrate further detail of a second portion for a ski strap and hanging device or ski strap assembly without a hanging device.
Figure 5B:
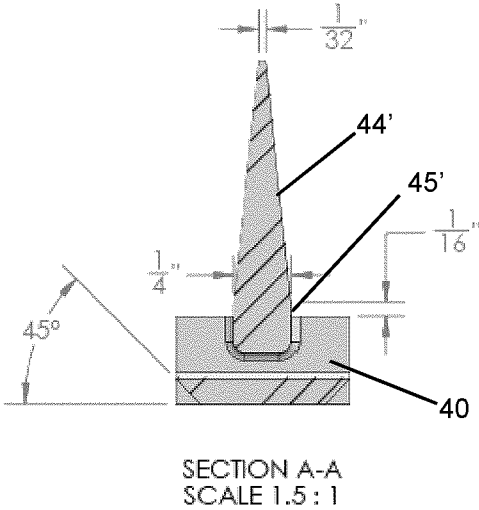
Figure 5C:
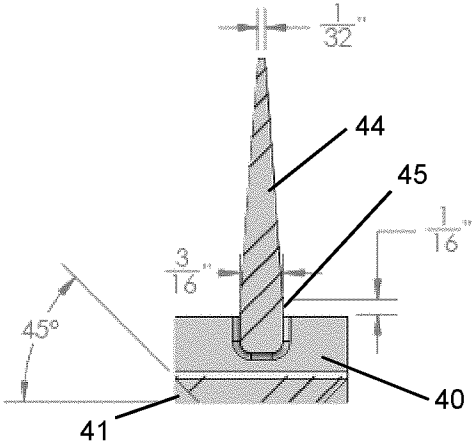
Figure 5E:
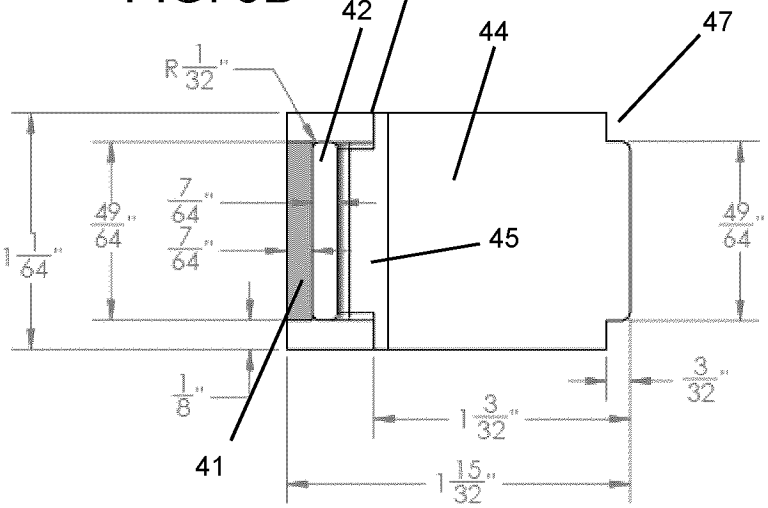
Figure 5D:
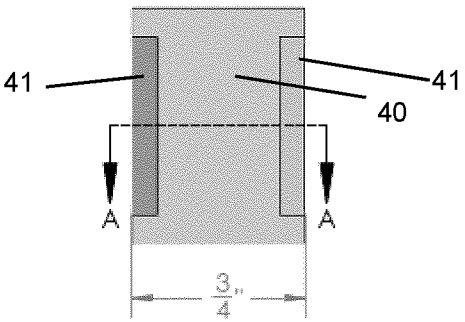

FIGS. 5A-5E illustrate further detail for the second portion 14. As indicated above, the second portion 14 can be used with the first portion 12 to assemble a hanging device 10, or can be used with another second portion 14 to assemble a secondary or non-hanging device 20, i.e. as an alternative ski strap. Similar to the first portion 12, the tab 44 of the second portion 14 is tapered and can include upper and lower notches 47 to permit the aforementioned interference fit with a first portion 12 or another second portion 14. As can be observed in FIGS. 5A and 5E, the second outer block 40 can also be formed with cutaways to provide upper and lower flanges that both enable the interference fit and increase the contact between the length 50 of the strap 16 and the skis S1, S2. FIG. 5B illustrates a tab 44' having a ¼" thickness, whereas FIG. 5C illustrates the tab 44 having a 3/16" thickness, similar to the alternatives shown for the first portion 12. The second portion 14 can also include sloped edges 41 for facilitating wrapping additional length 50 of the strap 16 around the device 10, 20 without imposing sharp edges. The slot 42 shown in FIG. 5E can also be rounded to impose a similarly contoured length 50 of strap 16, as discussed above.

It can be appreciated that the dimensions shown in FIGS. 4 and 5 are illustrative of suitable sizes to accommodate various ski sizes and shapes, but is not to be considered limiting. It may be noted that the tapering of the tabs 36, 44 allows the portions 12, 14 to be used with skis S1, S2 that are narrower than the total length of the tabs 36, 44, due to the overlap permitted by the tapered portions thereof. It can also be appreciated that either of the portions 12, 14, etc. described herein can be made from a plastic or rubber extrusion, or otherwise created as unitary pieces/components or from separate pieces that are subsequently assembled. Advantageously, the first and second portions 12, 14 are made from a hard plastic, high friction compound. The frictional engagement of portions 12, 14 made from such materials can inhibit slippage of the devices 10, 20 along the skis S1, S2 when secured thereto and are being hung.

Figure 6A:
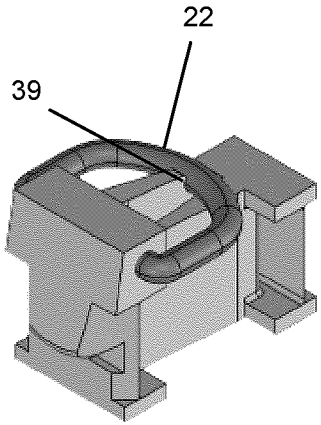
FIGS. 6A to 6E illustrate first and second portions of a ski strap and hanging device coupled to each other.
Figure 6B:
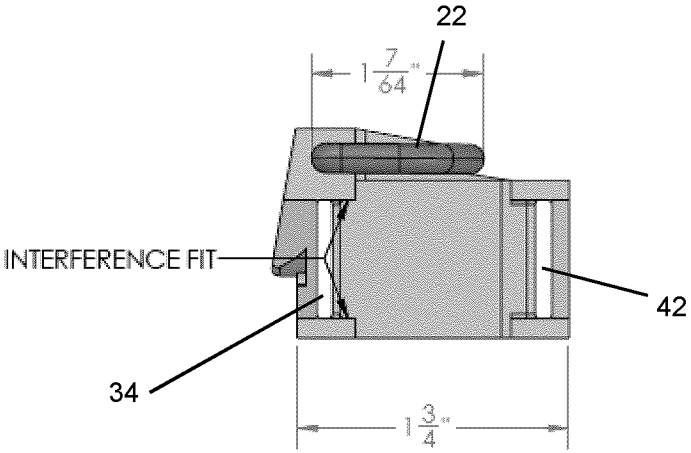
Figure 6C:
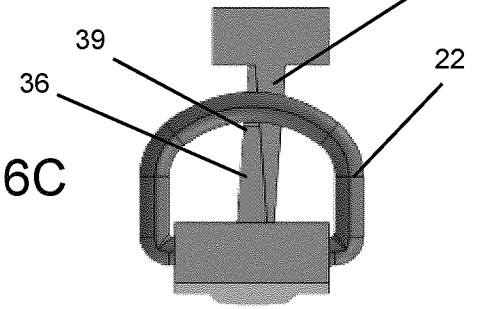
Figure 6D:
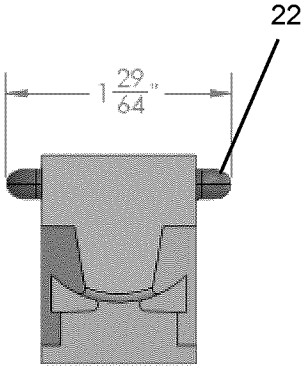
Figure 6E:
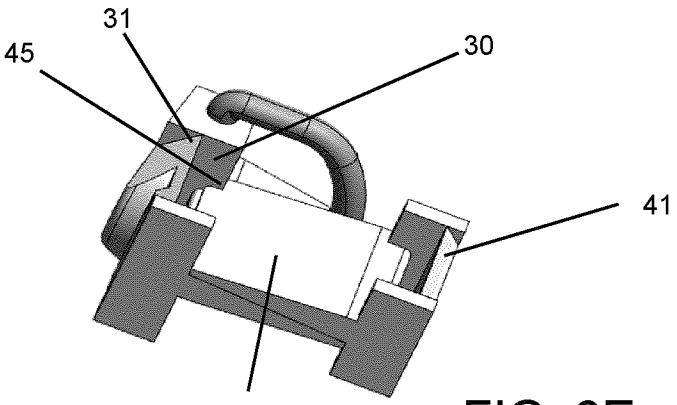

The interference fit between the first and second portions 12, 14 is illustrated in FIGS. 6A-6G. FIGS. 6A and 6B show the interference fit at each end between the notches 35, 47 in the tabs 36, 44 and the flanges formed in the first and second outer blocks 30, 40. FIGS. 4A-4C also illustrate storage of the loop 22 against the depression 39 in the first tab 36. The interference fit and the tapering of the tabs 36 44 provides a compact storage configuration for the device 10, as well as enabling relatively narrow skis S1, S2 to be accommodated. The alignment of the slots 34, 42 (see FIG. 6B) also allows the strap 16 to be fed through and wrapped around the first and second portions 12, 14 both when in use secured to a pair of skis S1, S2 and when in the storage configuration. While not shown in FIG. 6, it can be appreciated that the loop 22 can also be biased to enable it to snap against and away from the first portion 12. FIG. 6E shows the offset between the tapered edges 31, 41 and the tabs 36, 44 that permit the length 50 of the strap 16 to be wrapped around the first and second portions 12, 14.

Figure 6G:
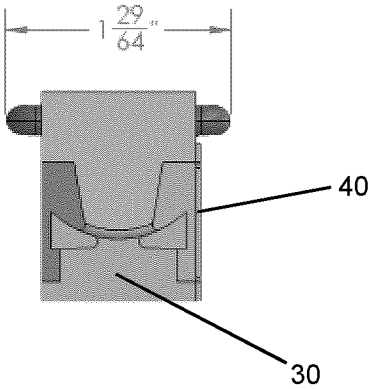
FIGS. 6F and 6G are similar to the views in FIGS. 6C and 6D with alternative exemplary dimensions.
Figure 6F:
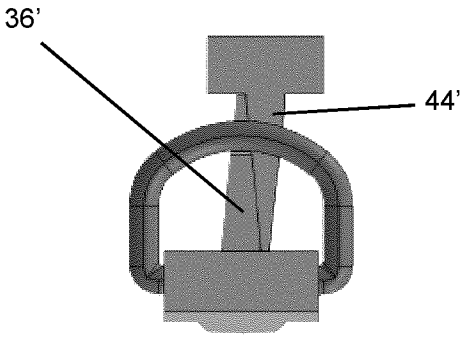
Figure 8A:
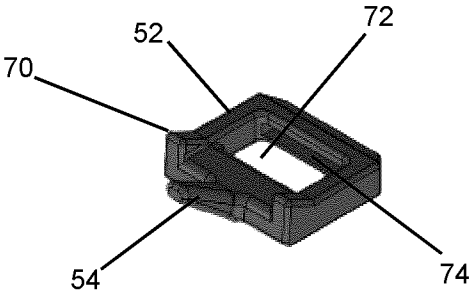
FIGS. 8A to 8D illustrate further detail for a buckle to be used with the ski strap shown in FIGS. 7A to 7F.
Figure 8B:
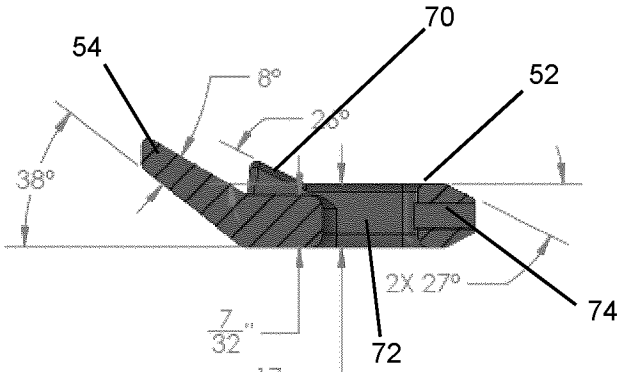
Figure 8D:
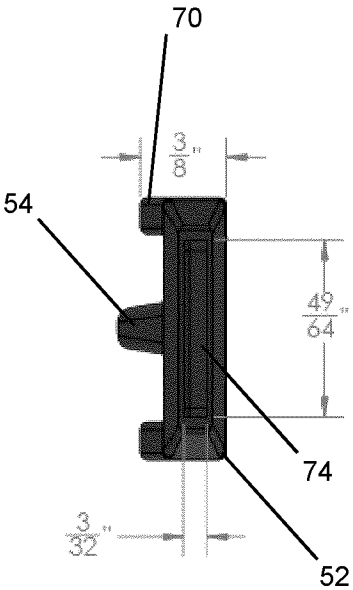
Figure 8C:
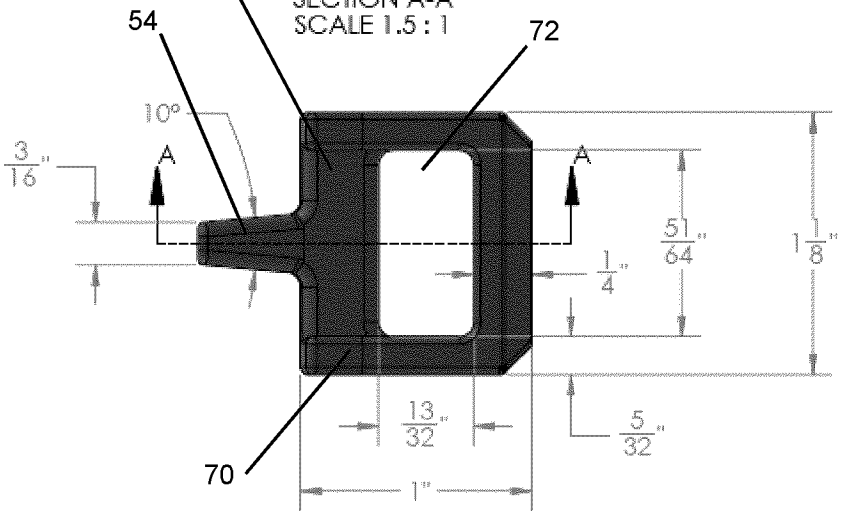

FIGS. 6F and 6G illustrate fitment of the first and second portions 12, 14 with the relatively wider ¼" thickness of the tabs 36', 44'.

The length 50 of the strap 16 suitable to be used with the devices 10, 20 is shown in FIGS. 7A-7F. While an existing Voile-type strap could be used with the devices 10, 20, it has been found that various additional details in the length 50 of the strap 16 can facilitate the ease of use of the device 10. For example, to reduce assembly efforts and to permit the length 50 to be replaced (e.g., if chewed, cut or severed), the length 50 can be removable from the buckle 52. This is permitted by including an obstruction 60 at a base end of the length as shown in FIG. 7A. This allows the tapered distal end of the length 50 to be fed through the buckle 52 (details provided below) until the obstruction abuts the buckle 52. A thicker portion 62 of the length 50 can also be provided adjacent the obstruction 60 for providing a slight frictional engagement between that portion 62 of the length 50 and the slot 34, 42 of the portion 12, 14 being located at that end of the length 50. This keeps the portion 12, 14 in place when setting up assembly of the device 10 but still allowing movement of the portion 12, 14 along the length 50 when tightening the strap 16. To that end, an arrow 63 or other indicia can be provided adjacent the thicker portion 62 to guide the user to slide the portion 12, 14 being used at that end towards the buckle 52.

Figure 14:
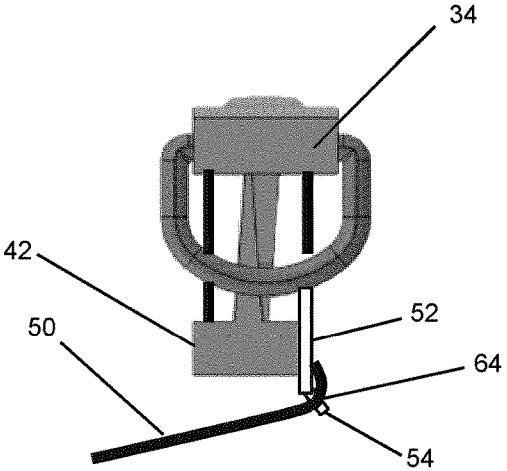
FIG. 14 is a plan view of a ski strap and hanging device in a storage configuration.

A first hole 64 can also be provided adjacent the arrow 62, which has been found to be located in a suitable place for binding the strap 16 around the first and second portion 12, 14 (or two second portions 14) for storage (see also FIG. 14). The series of holes 56 along the main central portion of the length 50 can also be provided with embossed areas 66 between each hole 56 to promote stretching of the rubber material. In this example, the embossed areas 66 are provided by including lettering between the holes 56. As best seen in FIG. 7E, a ramp 68 can also be formed into the end of the length 50 of the strap 16 to permit the first and second portions 12, 14 to slide thereover in one direction while blocking the portions 12, 14 from sliding off the length 50 of the strap 16 in the other direction. FIG. 7F is a schematic cross-sectional view illustrating that the length 50 of the strap 16 can be contoured to match a contour applied to the slots 34, 42 in order to enforce certain straps 16 to be used with the first and second portions 12, 14.

The buckle 52 is shown in greater detail in FIGS. 8A-8D. The buckle 52 is formed as a loop, similar to a D-ring, and includes an opening 72 for permitting passage of the length 50 of the strap 16. At one end of the buckle 52 is the angled tooth 54, best shown in FIG. 8B. The opening 72 and the direction of the tooth 54 enable the length 50 of the strap 16 to be fed through the buckle 52 and to turn back against itself to align a hole 56 with the tooth 54 to tighten the strap 16 against the skis S1, S2 (see also FIGS. 3A and 3B described above). The buckle 52 can also include a wing 70 on either side of the tooth 54 to create a path for guiding the length 50 of the strap 16 to avoid misalignment of the length 50 and the tooth 54. The cross member opposite the tooth 54 includes a slot 74 that is sized to enable the length 50 of the strap 16 to be coupled to the buckle 52. Such assembly includes the tapered end of the length 50 being fed through the inside opening of the slot 74 and pulled through until the obstruction 60 abuts the same inside opening.

Figure 9A:
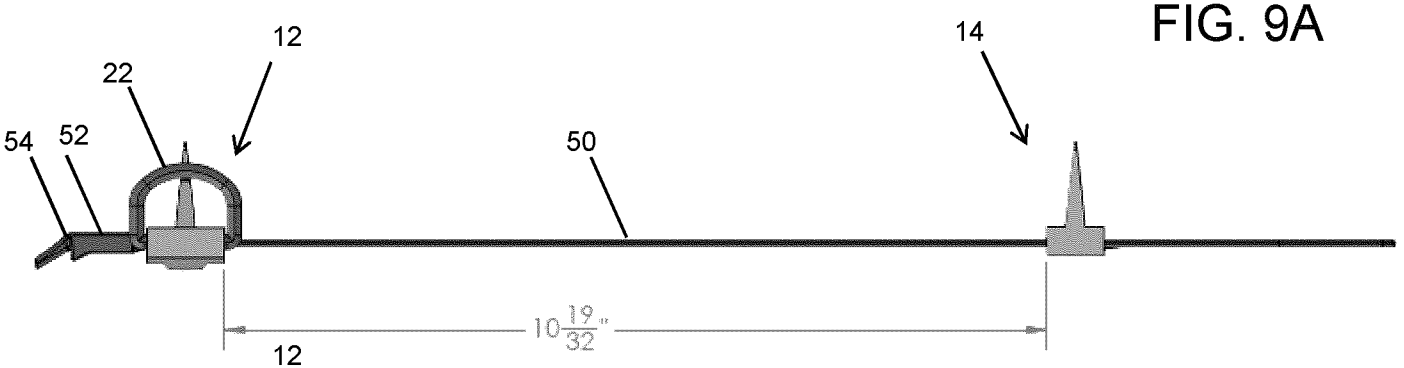
FIGS. 9A and 9B illustrate plan and profile assembly views of a ski strap and hanging device.
Figure 9B:
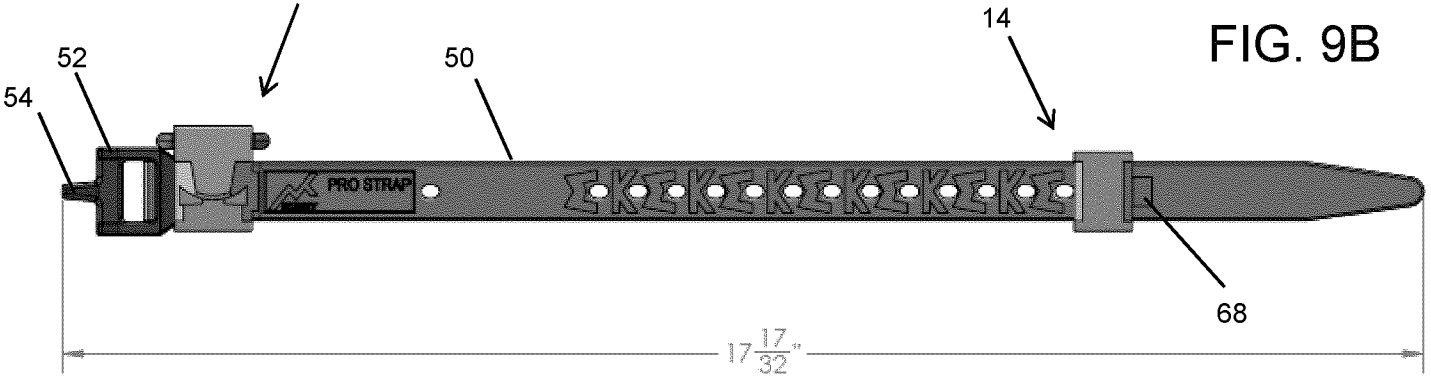
Figure 9C:
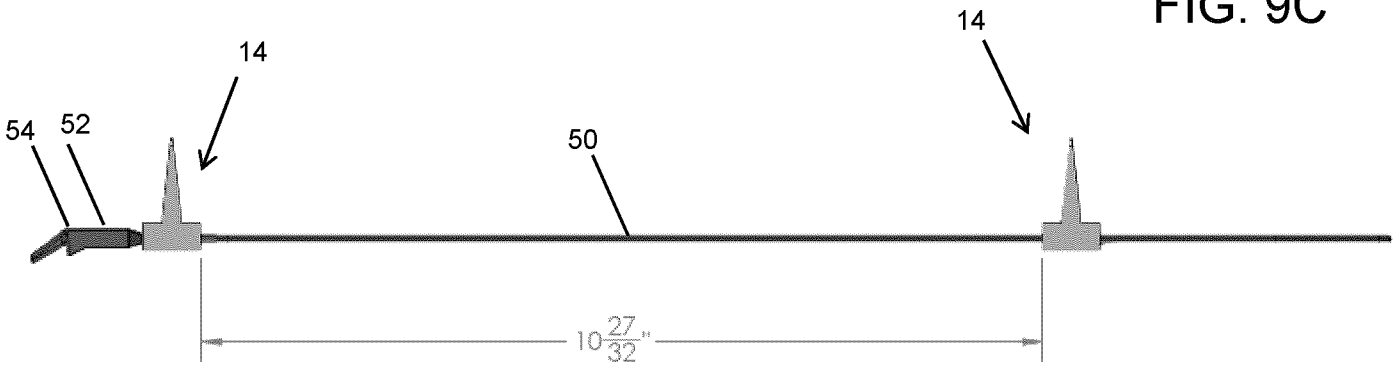
FIGS. 9C and 9D illustrate plan and profile assembly views of a skit strap assembly utilizing two of the second portions shown in FIG. 5.
Figure 9D:
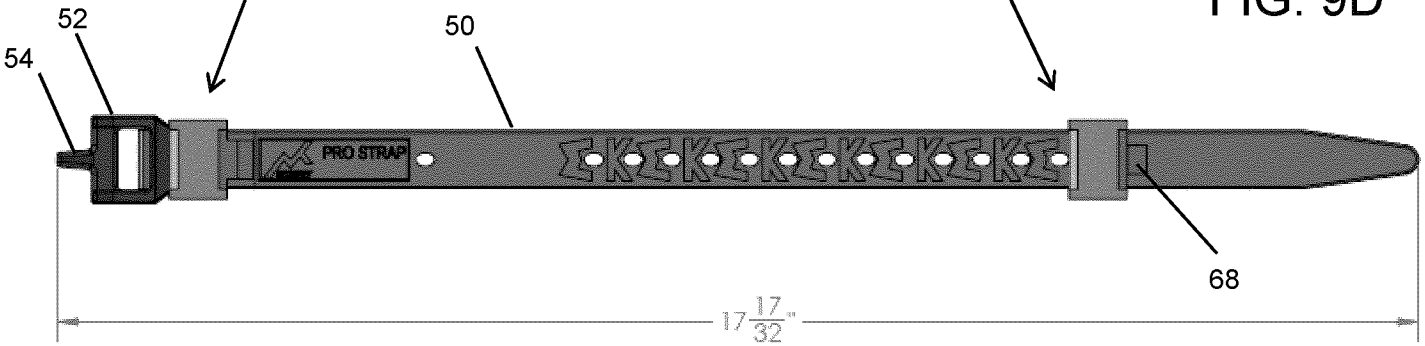

An assembled strap 16 comprising a buckle 52 and length 50, is shown in FIGS. 9A-9B and 9C-9D. FIGS. 9A-9B illustrate a device 10 that is assembled by locating the first portion 12 at the buckle end of an assembled strap 16, and the second portion 14 located near the ramp 68. The device 20 shown in FIGS. 9C-9D includes a second portion 14 located at the buckle end of the assembled strap 16, and another second portion 14 located near the ramp 68. The device 10, 20 can secure a pair of skis S1, S2 together by inserting the tabs 36, 44 between the skis S1, S2 and pulling the length 50 of the strap 16 through the second portion 14 and towards the buckle 52. The tapered end of the length 50 is fed through the opening 72 and looped back towards itself and over the tooth 54 until tightened and achieving alignment of one of the holes 56 with the tooth 54 by stretching the length 50 over the tooth 54 until the alignment is made.

Figures 10A, 10B, 10C, 10D:
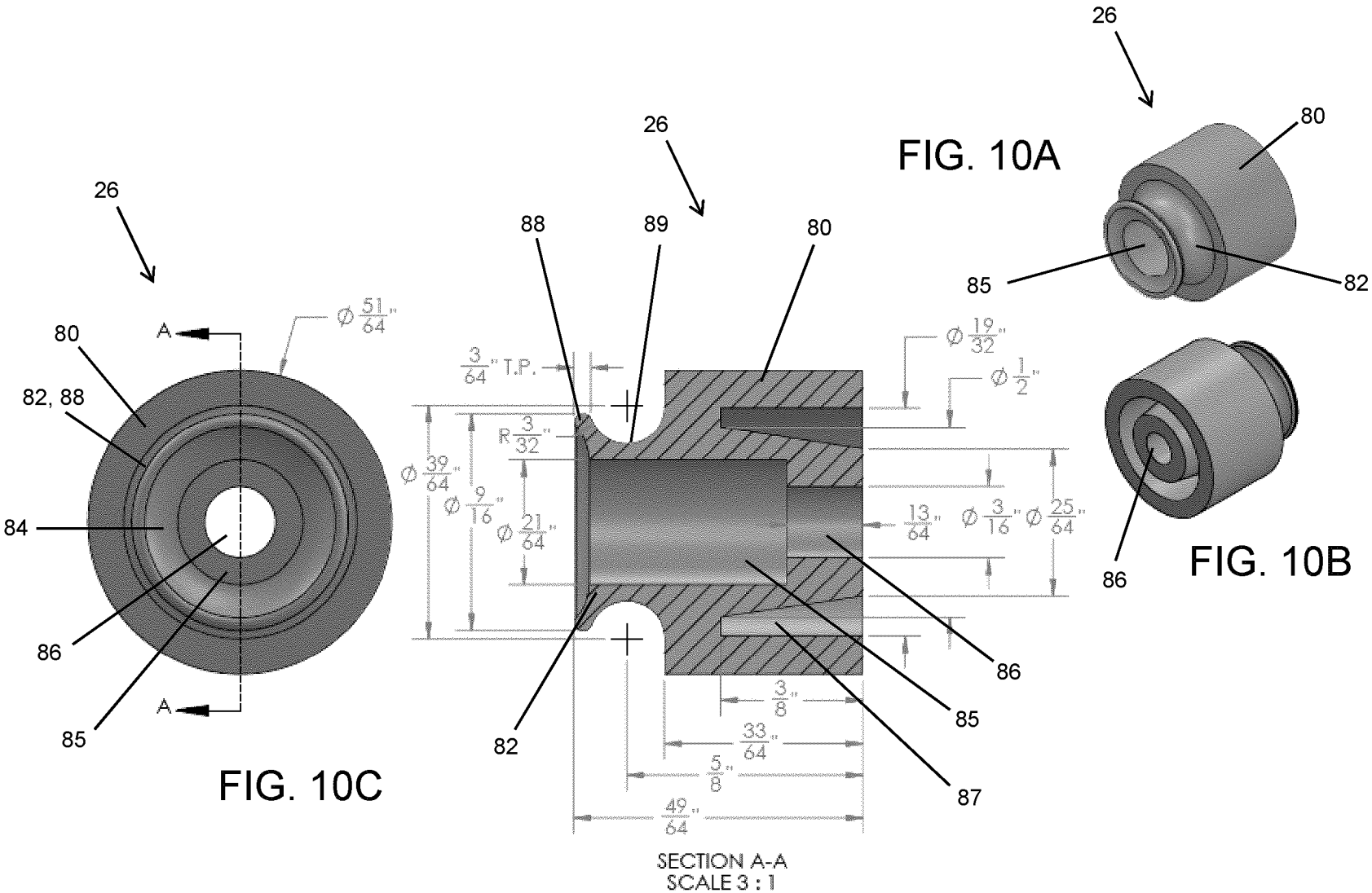
FIGS. 10A to 10D illustrate an upper post for the hanging mechanism shown in FIG. 1.
Figures 11A, 11B, 11C, 11D:
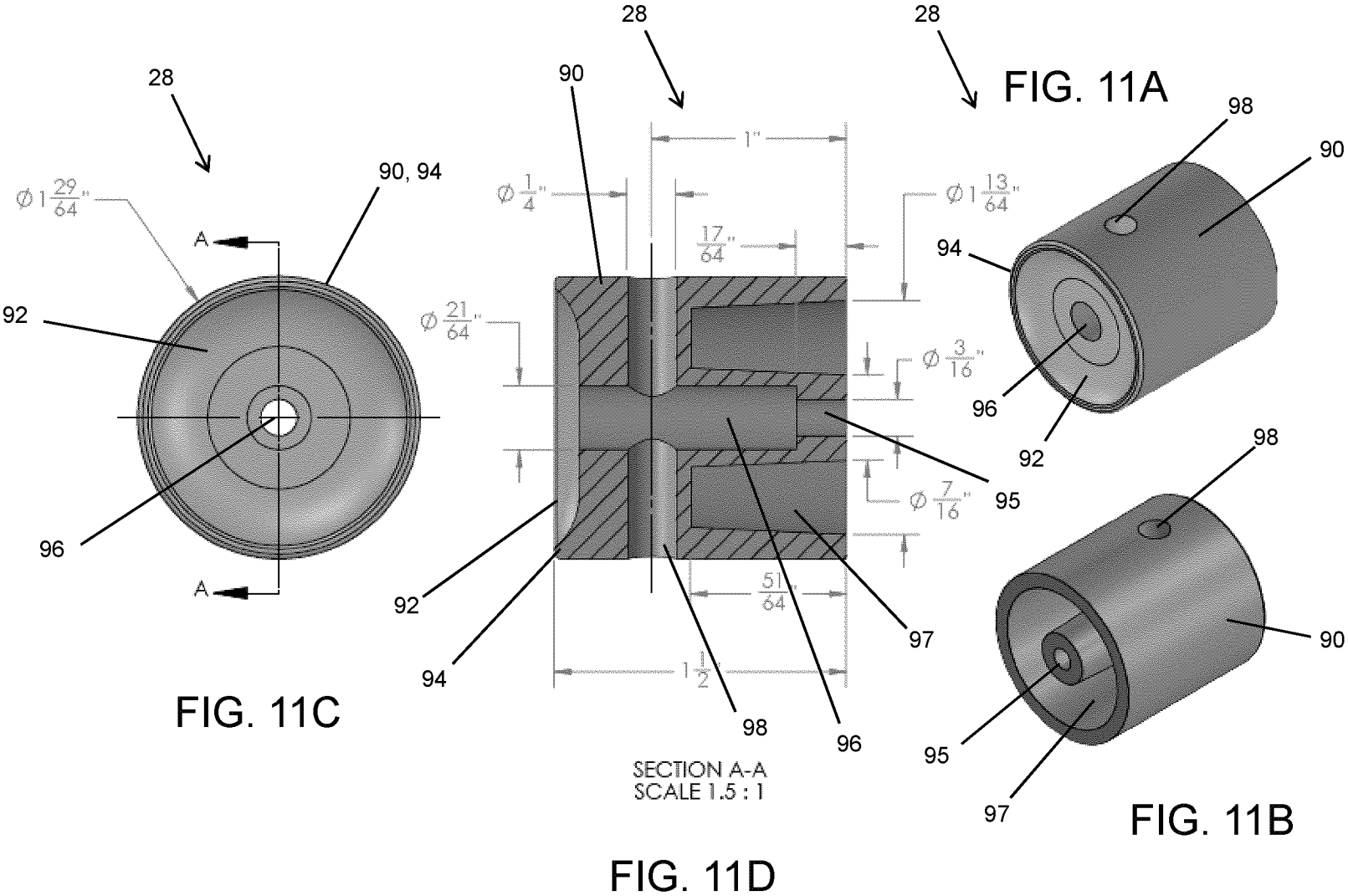
FIGS. 11A to 11D illustrate a lower post for the hanging mechanism shown in FIG. 1.

The hanging mechanism 24 shown in FIG. 1 that includes the upper post 26 and lower post 28 is shown in greater detail in FIGS. 10 and 11. FIGS. 10A-10D show details of, and example dimensions for, the upper post 26. The upper post 26 is cylindrical in shape and includes a base cylinder 80 with a narrower protruding rim 82. The rim 82 defines a trough 89 into which the loop 22 can be securely seated. The trough 89 continues outwardly to form a lip 88. The lip 88 may continue inwardly to form a concave surface 84 to minimize the outer contact surface to that of the lip 88, which is preferably rounded as shown in FIG. 10D. The concave surface 84 continues towards a central chamber 85 that extends partially into the base cylinder 80 and terminates at a mounting hole 86 that is sized to permit a screw or other fastener to pass therethrough. The countersunk mounting hole 86 allows either a shorter screw to be used to anchor the post 26 to the wall 29, or more of that screw to penetrate the wall 29. The base cylinder 80 can also include a void 87 to minimize the material used. It can be appreciated that by using a circular shape for the post 26, the post 26 can be mounted to the wall 29 without having concern for a need to "level" the post 26 itself (i.e. because of the circular symmetry). Instead, the only concern for mounting the post 26 is to ensure that the upper post 26 is mounted at an appropriate height, and that the lower post 28 is positioned relative to the upper post 26, at an appropriate distance as herein described.

FIGS. 11A-11D illustrate detail of the lower post 28. The lower post 28 includes a continuous cylindrical body 90 that includes a lip 94 that is preferably rounded as shown, and continues inwardly towards a concave surface 92 to minimize contact with the skis S1, S2 to only the lip 94. The concave surface continues towards a central chamber 96 that extends towards an inner mounting hole 95. The mounting hole 95 is sized to permit insertion of a mounting screw, similar to the upper post 26. The body 90 includes a transverse passage 98 that passes through the chamber 96 across the body 90. The passage 98 is suitably sized to permit the length of a wire lock to pass therethrough. The body 90 may also include a void 97 to minimize the material used.

Figure 12:
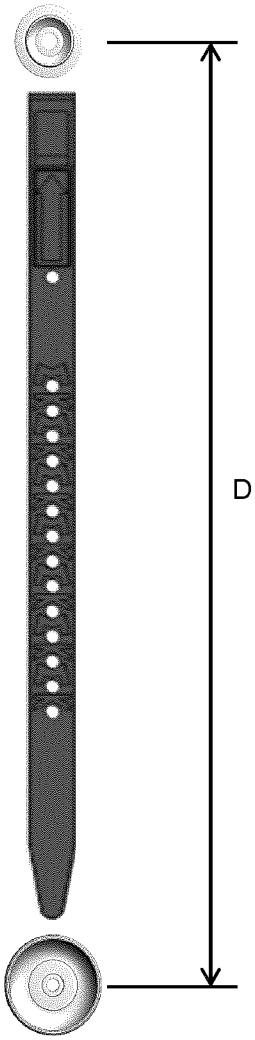
FIG. 12 illustrates an installation technique for providing a minimum separation between the upper and lower posts.

FIG. 12 shows an elevation view of the posts 26, 28 with a separation D. It has been found that a separation of at least 12" allows the skis S1, S2 to hang substantially vertical as illustrated in FIG. 1. By installing the upper post 26 and then using the length 50 of the strap 16 for guidance, the lower post 28 can be consistently placed at a suitable distance below the upper post 26. Alternatively, a stencil can be provided, either with or on the packaging for the device 10, 20, which provides suggested installation points for the posts 26, 28 relative to each other.

Figure 13:
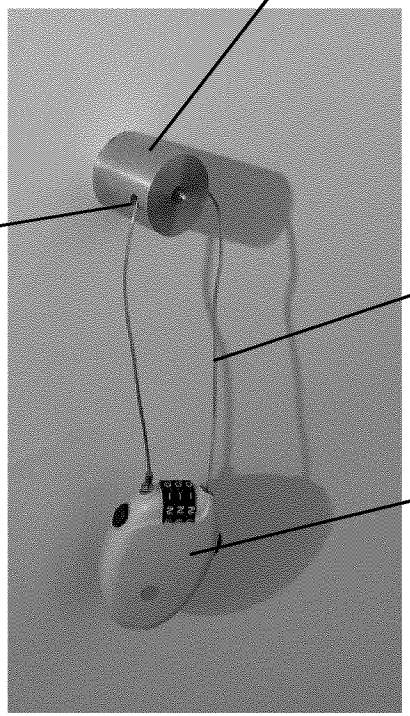
FIG. 13 illustrates a wire lock used in combination with the lower post shown in FIG. 11.

FIG. 13 illustrates a length of wire 102 inserted through the passage 98 permitting a ski lock 100 to be used. It can be appreciated that when the wire 102 is inserted in the passage 98, one cannot access the screw behind it, thus inhibiting theft when a pair of skis S1, S2 are hanging on the upper post 26, and locked to the lower post 28.

As indicated above, FIG. 14 illustrates a stored configuration for the device 10, in which the first and second portions 12, 14 are coupled to each other using the interference fit described above, and the strap 16 is fed through the slots 34, 42 and secured to the tooth 54 using the hole 64 adjacent the arrow 63. The length 50 of the strap 16 can be wrapped around the portions 12, 14 to permit compact storage of the device 10. A similar storage configuration can be used for a device 20 that includes a pair of second portions 14.

Figure 15:
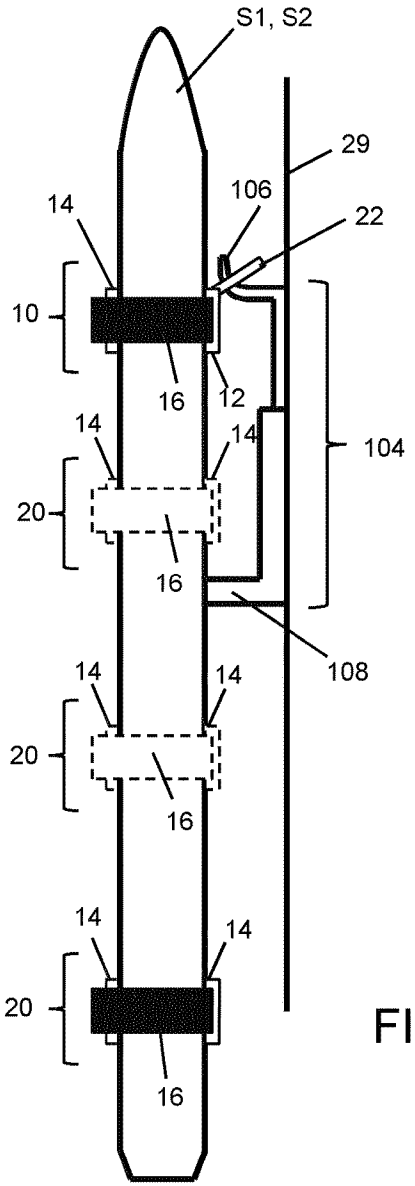
FIG. 15 is a side view of a pair of skis held by a plurality of ski straps, with an alternative hanging mechanism used therewith.

It can be appreciated that the hanging mechanism 24 is only one example mechanism for utilizing the hanging device provided by the first portion 12. For example, as shown in FIG. 15, a single structure 104 having a hook 106 at its upper end and a bumper 108 at its lower end can be secured to the wall 29 and provide a point at which to hang the loop 22. Further detail regarding this and other hanging mechanism implementations can be found, for example, in co-pending PCT Application No. PCT/CA2016/051422 filed on Dec. 2, 2016, the contents of which are incorporated herein by reference.

Figure 16:
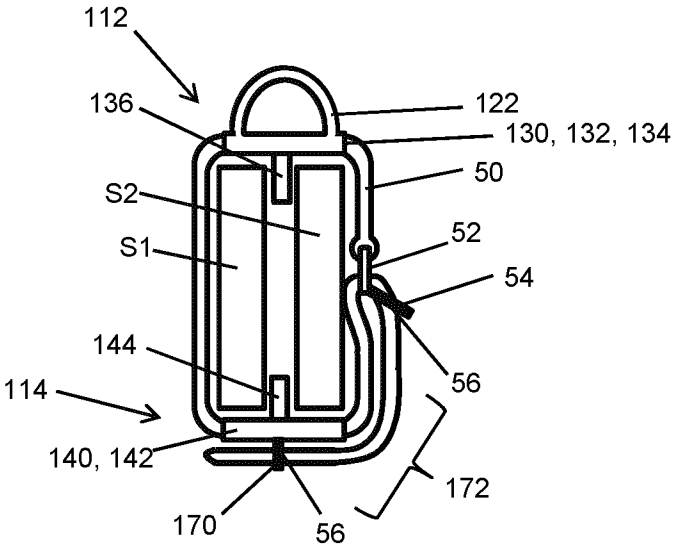
FIG. 16 is a plan view of a secured ski strap and hanging device.

FIG. 16 provides an alternative implementation for the first and second portions 112, 114, in which the tabs 136, 144 are not tapered. It can be appreciated that the tabs 136, 144 could also be fully tapered without the perpendicular portions that are shown in FIGS. 3A-3C. FIG. 16 also illustrates the length 50 of the strap 16 secured to the buckle 52 using the tooth 54. To avoid excess length 172 that extends beyond the tooth 54 from being loose, a pin 170 can be provided, over which another hole 56 in the length is secured. As seen in FIG. 16, the pin 170 extends from the second outer block 140 in a direction opposite that of the second inner tab 144. It can be appreciated that the pin 170 can be fixed to the second outer block 140, or can be moveable. For example, the pin 170 could include a base and be fed through a pair of holes 56, one adjacent ski S1 and the other in the excess length 62.

While the examples shown in FIGS. 2-16 illustrate a Voile-type strap 16, it can be appreciated that other strap types can be used. For example, the strap 16 could instead include female and male Velcro strips respectively, to releasably secure the strap 16 to itself can also be appreciated that other releasable securing mechanisms can be used to hold the strap 16 in place, including, for example, snaps, clasps, etc.

Figure 17:
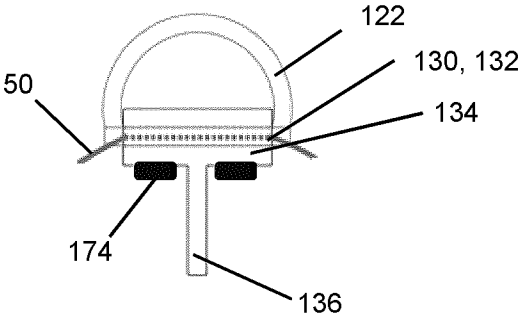
FIG. 17 is a partial plan view of a hanging device end portion with a pair of frictional members.

To provide suitable (or additional) friction between the inner blocks 30, 40, and the sides of the skis S1, S2 (i.e. to avoid the devices 10, 20 slipping along the skis S1, S2 when they are being hung), one or more pads 174 can be provided on the inner surfaces of the blocks 30/130, 40/140 as shown in FIG. 17. In this way, when the strap 16 has been secured as shown in FIG. 3 or 16, the pads 174 bear against the skis S1, S2 to inhibit slippage.

Figure 18A:
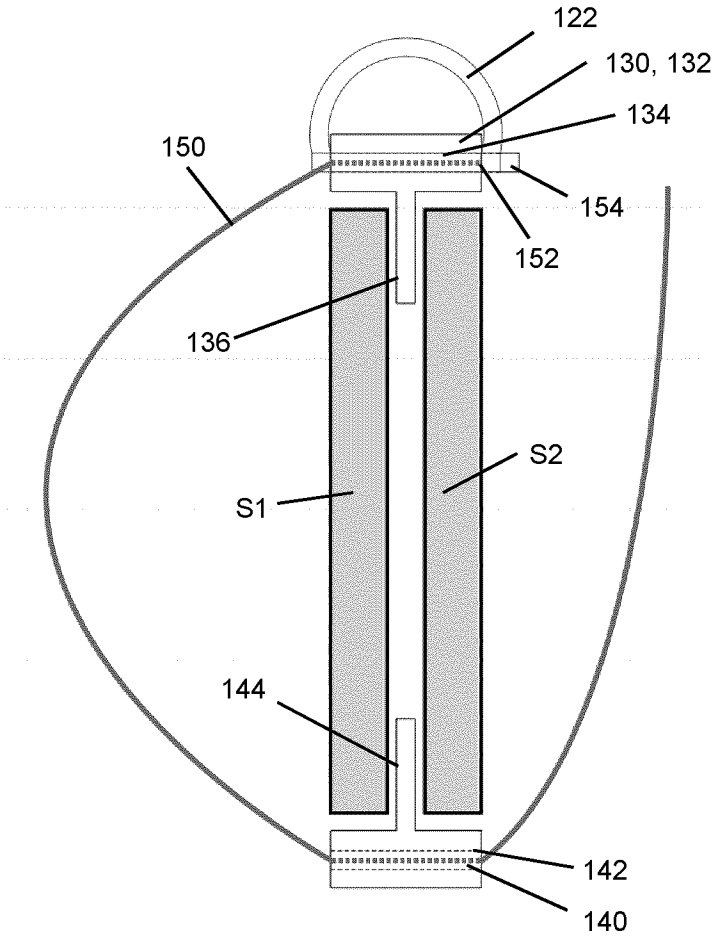
FIG. 18A is a schematic plan view of a ski strap and hanging device being secured to a pair of skis in another configuration.

As indicated above, the use of a Voile-type strap 16 is only one possible implementation. For example, as shown in FIG. 18A, an integrated strap can be used, where the length 150 is secured at one end to the first outer block 130. The length 150 in this implementation is fed through the second slot 142 in the second outer block 142 and towards a tooth 154 extending from the first outer block 130. The tooth 154 operates in a manner similar to the tooth 54 shown in FIGS. 3 and 16, with a hole 156 in the length 150 being secured over the tooth 154. It can be appreciated that the tooth 154 can be perpendicular to the inner tab 136 or can be angled like the tooth 54. Moreover, a fixed or movable pin 170 (not shown in FIG. 18A) can also be used to secure any excess portion of the length 150.

Figure 18B:
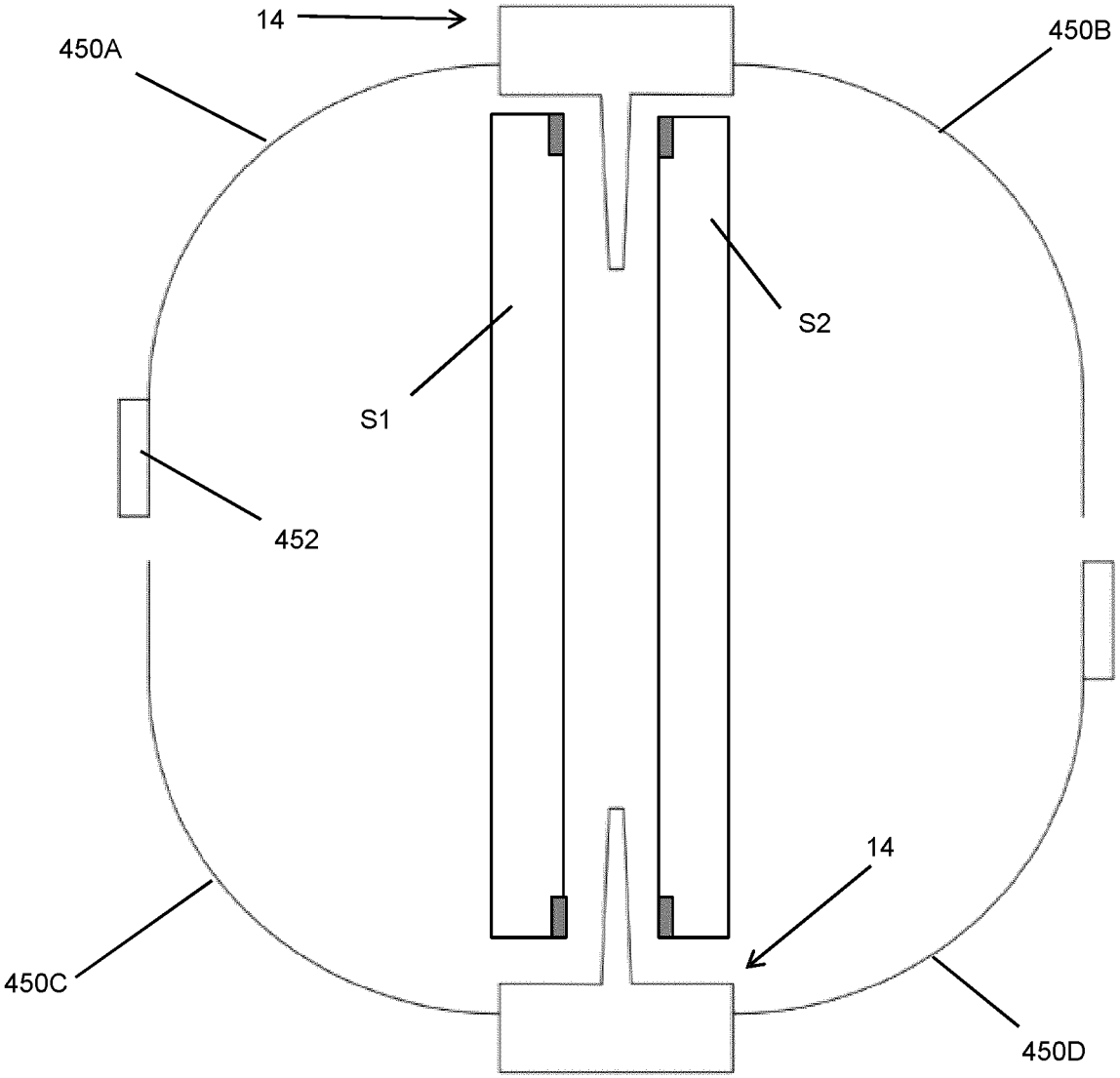
FIG. 18B is a schematic plan view of a ski strap assembly with multiple strap length portions used to secure the ski strap assembly to a pair of skis.

FIG. 18B shows yet another configuration for the strap 450, which includes four segments 450A, 450B, 450C, and 450C, each extending from the portions 14. In the configuration shown in FIG. 18B, the segments 450A, 450C can be pulled towards each other, while the segments 450B, 450D are pulled towards each other, and latched or otherwise secured or connected to each other using an adjustable securing mechanism 452 such as a ratchet-like connection, etc. It can be appreciated that the segments 450A-450D can be fixed to the portions 14 or part of a pair of segments 450A/450B and 4500/450D that are fed through slots in the portions 14. It can also be appreciated that a similar configuration can be applied to a first portion 12. Similarly, a pair of the segments (e.g. 450A, 450C) can be attached with the other pair of segments (e.g., 450B, 450D) being releasably coupled to secure the strap 450 around the skis S1, S2.

Figures 19A, 19B, 19C:
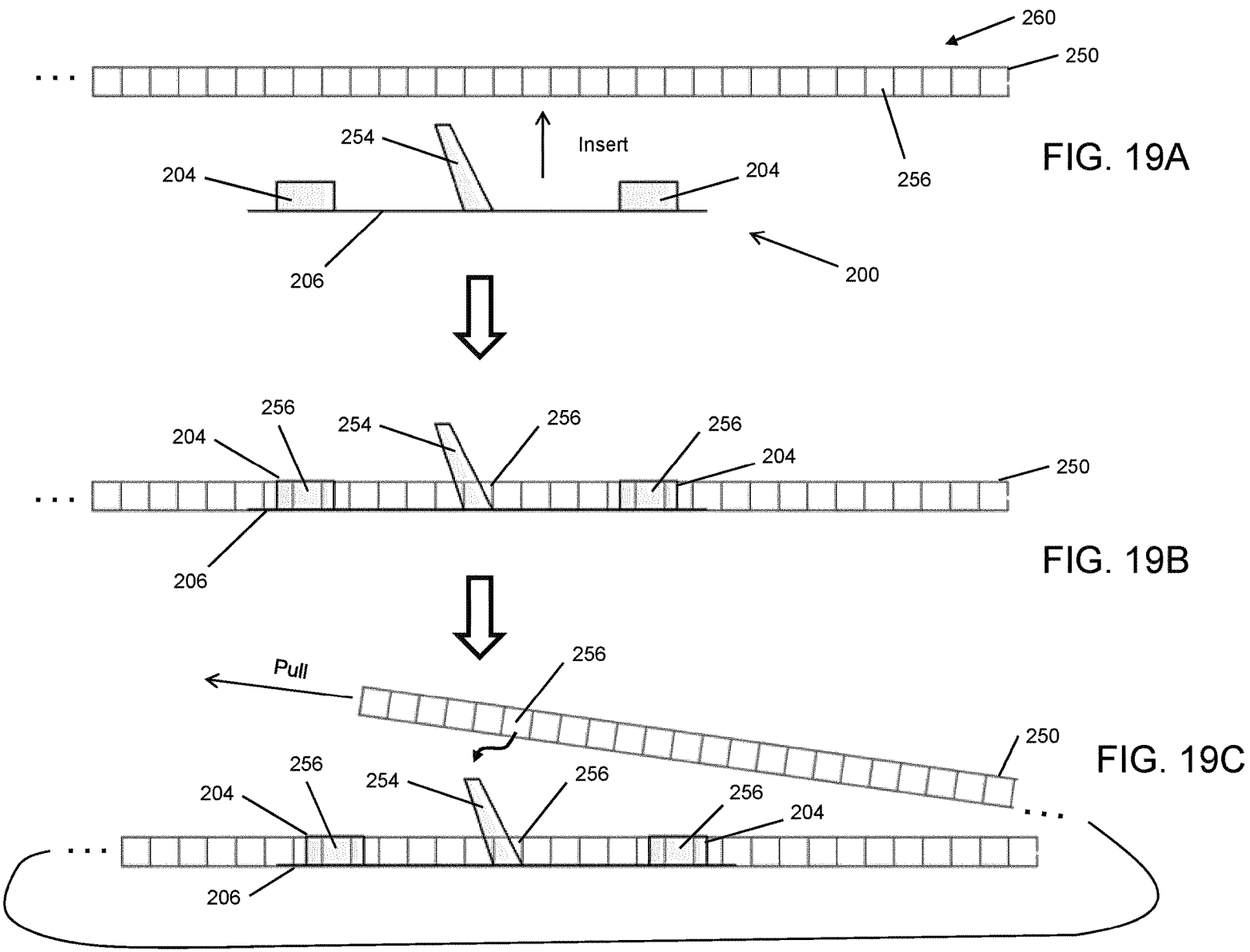
FIGS. 19A to 19C illustrate a moveable tooth for securing a strap.

Other types of straps can be used, for example a Voile-type strap that does not include the tooth 54. For such straps, a moveable tooth structure 200 as shown in FIG. 19A can be used. The moveable tooth structure 200 includes a pair of posts 204 supported by a base 206. The base 206 also supports an angled tooth 254, in this example, in a middle portion thereof. The structure 200 is secured to a portion of a length 250 of a strap 260 by inserting the posts 204 and the angled tooth 254 into correspondingly aligned holes 256 in the length 250, as shown in FIG. 19B. In this way, as shown in FIG. 19C, a portion of the length 250 can be pulled over the angled tooth 254 to have the angled tooth 254 extend through a hole 256 as described above with respect to the Voile-type strap and buckle 252.

Figure 21:
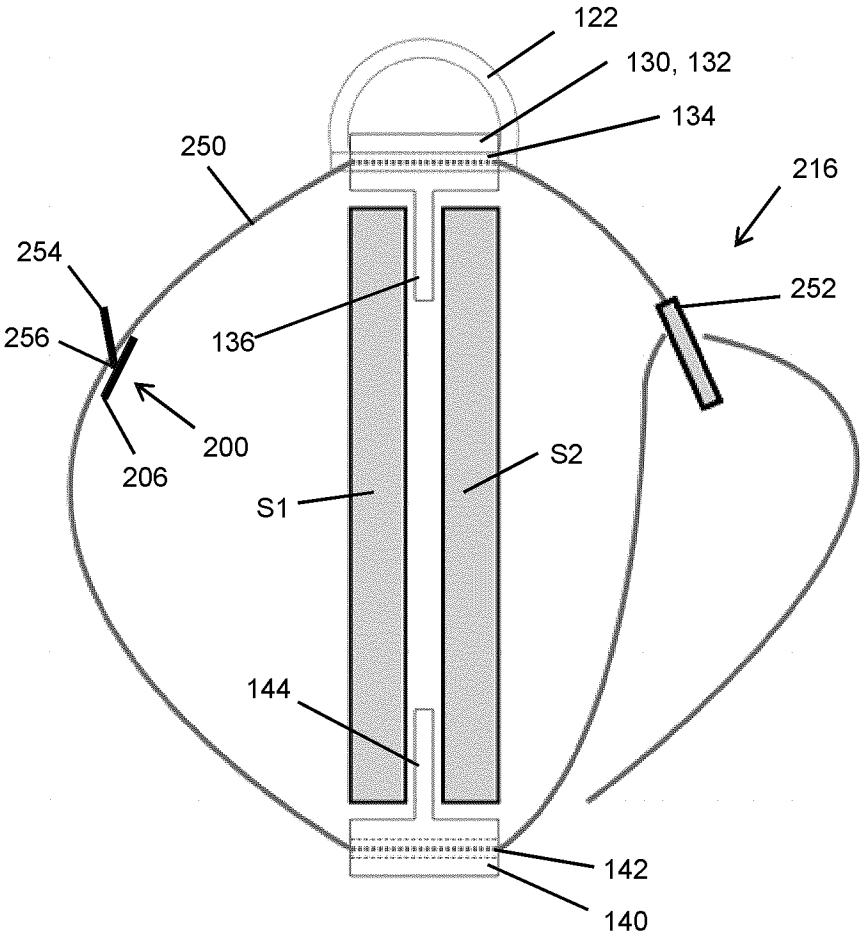
FIG. 21 is a schematic plan view of a ski strap and hanging device utilizing the strap shown in FIGS. 19A to 19C in another implementation.
Figure 20:
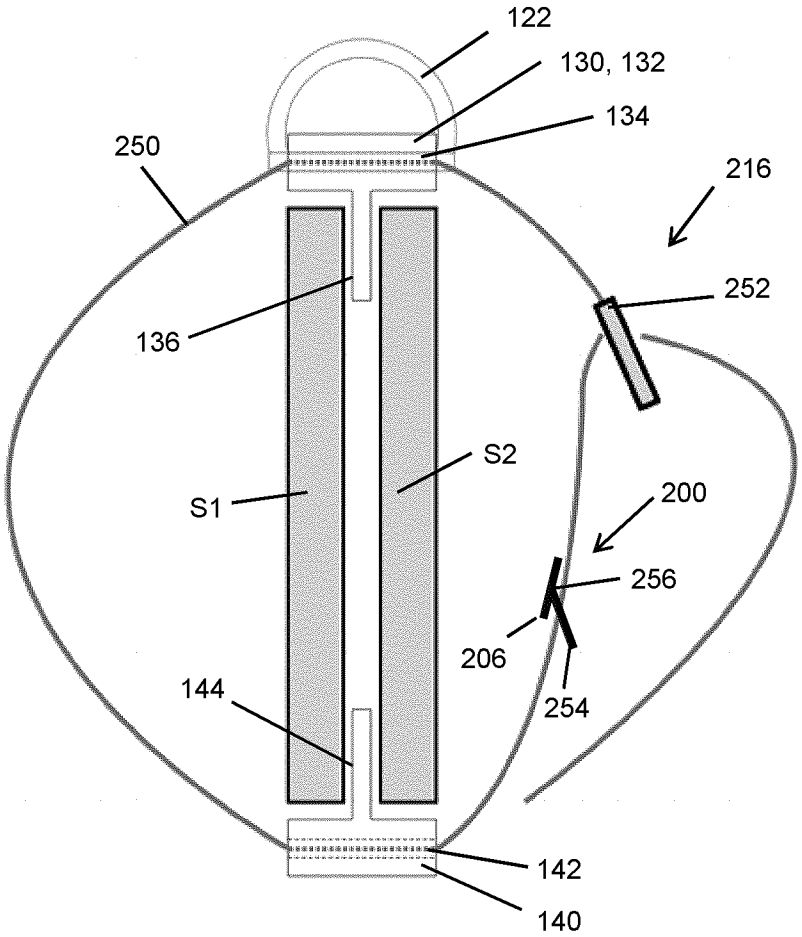
FIG. 20 is a schematic plan view of a ski strap and hanging device utilizing the strap shown in FIGS. 19A to 19C in one implementation.

FIG. 20 illustrates a view of the device 10 that is similar to FIG. 18 with the strap 260 shown in FIG. 19. As can be seen, the structure 200 can be inserted at any convenient portion along the length 250 to enable the free end of the length 250 to be secured against itself by pulling it over the angled tooth 254. FIG. 21 illustrates that the structure 200 can be placed along different portions of the length 250.

Figure 22A:
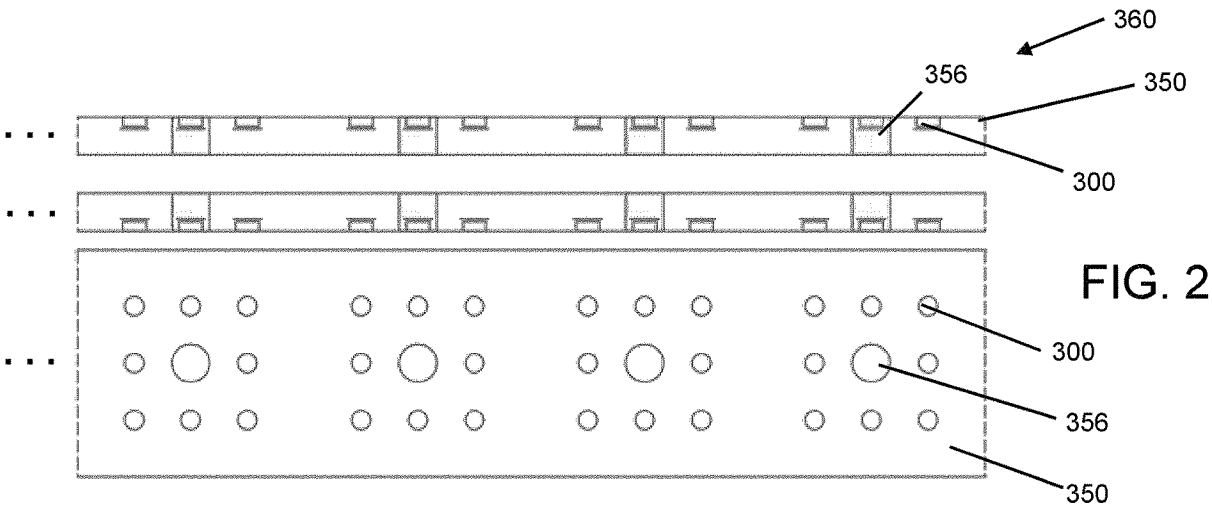
FIGS. 22A to 22E illustrate a moveable button for securing a strap.
Figure 22B:
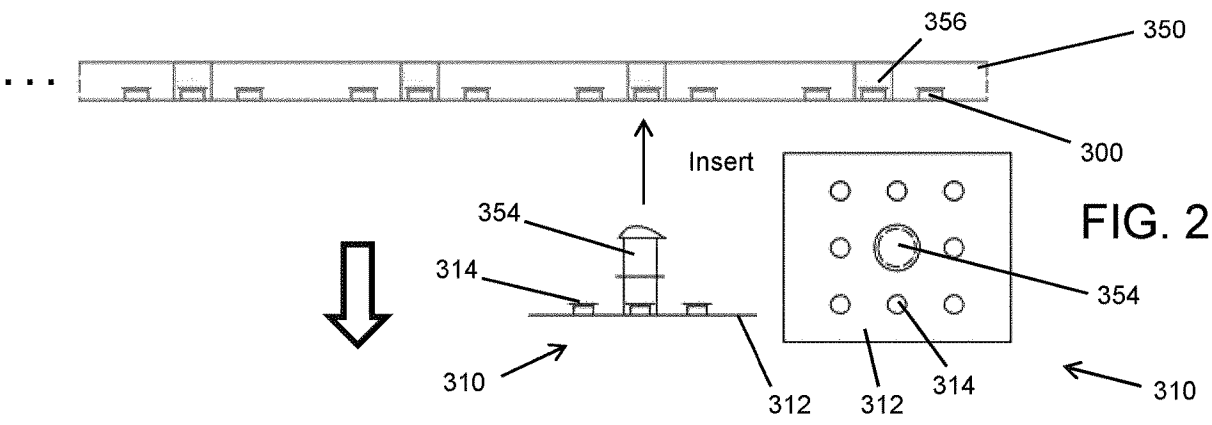
Figure 22C:
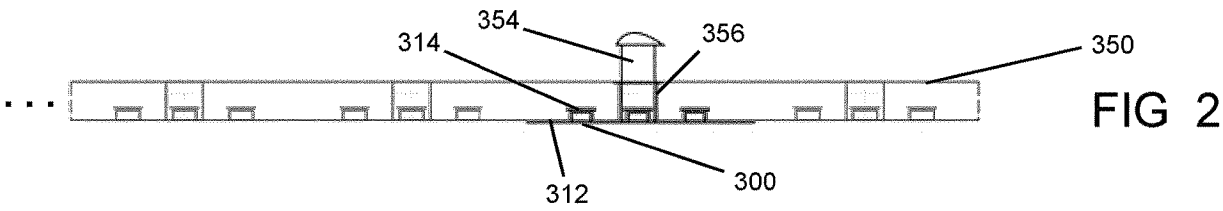

FIGS. 22A-22E illustrate another implementation of a strap 360 with a moveable securing mechanism. Referring first to FIG. 22A, the strap 360 is shown in both plan and profile views. The strap 360 has a length 350 that includes a series of attachment holes 356 therealong, each hole 356 being surrounded by an array of mounting holes 300. As illustrated in FIGS. 22B and 22C, the attachment holes 356 permit passage of a moveable button 354 that is supported on a moveable button structure 310. The moveable button structure 310 also includes an array of attachment posts 314 that are spaced to be in alignment with the array of mounting holes 350 in the strap 360 when the moveable button 354 is inserted into a particular attachment hole 356. In this way, the moveable button structure 310 can be attached to the strap's length 350 at any one of a plurality of positions therealong, to accommodate different widths and thicknesses for the skis S1, S2 being secured to each other.

Figure 22D:
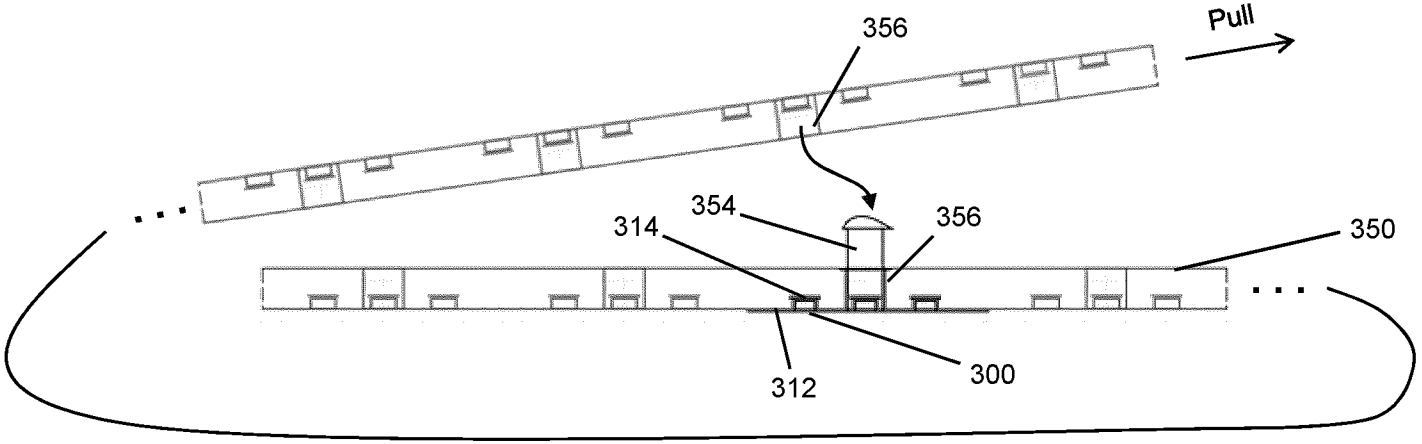
Figure 22E:
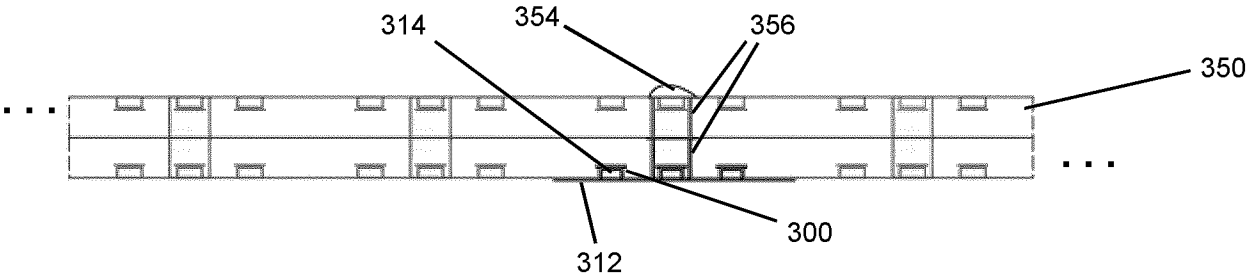

As shown in FIGS. 22D and 22E, after securing the structure 310 to the strap 360 as discussed above, the length 350 of the strap 360 can be pulled (and, if applicable stretched) over the button 354 and a suitably aligned attachment hole 356 fed over the button 354 such that it extends therethrough to secure the length 350 of the strap 360 to itself as illustrated in FIG. 22E.

Figure 23:
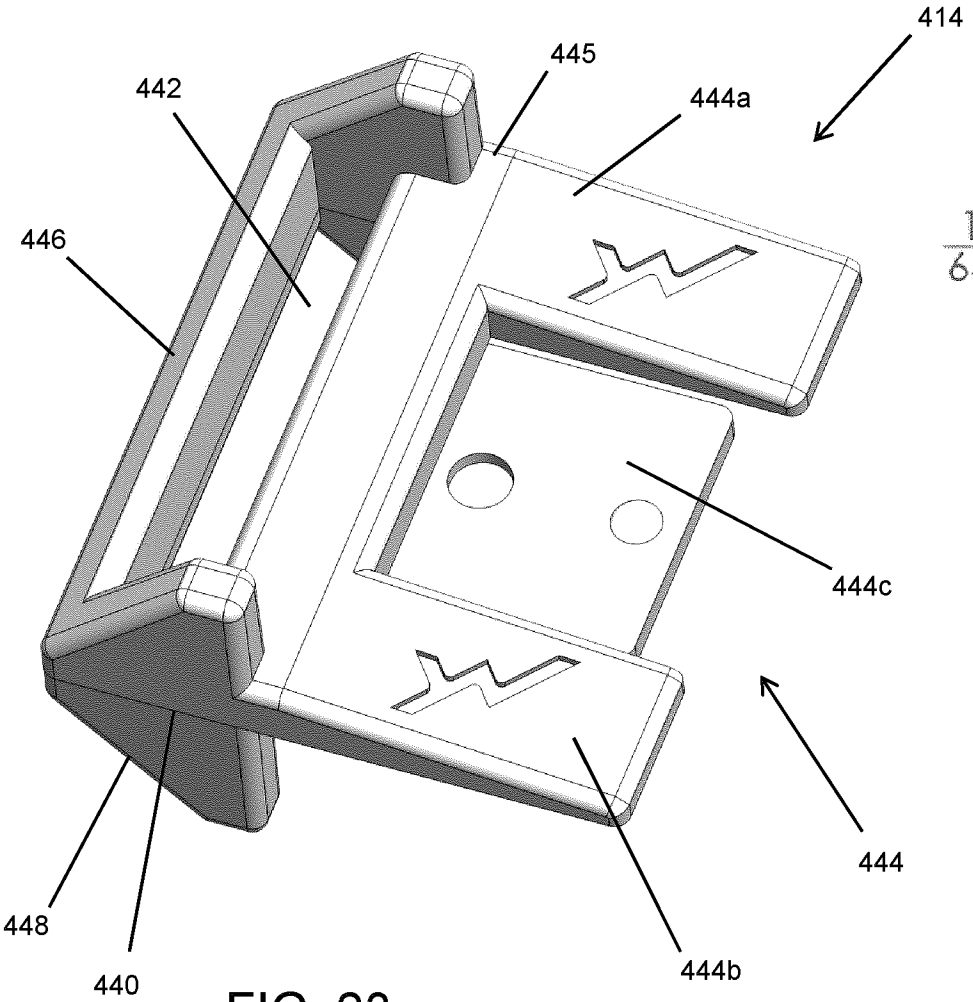
FIG. 23 is a perspective view of an end portion for use in a ski strap assembly in another implementation.
Figure 27:
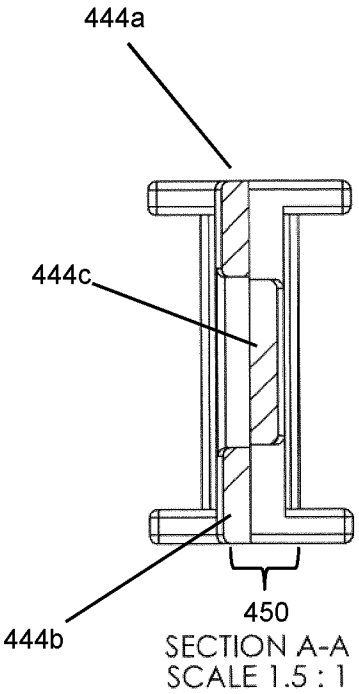
FIG. 27 is a cross-sectional view of the end portion of FIG. 26 along line A-A.
Figure 28:
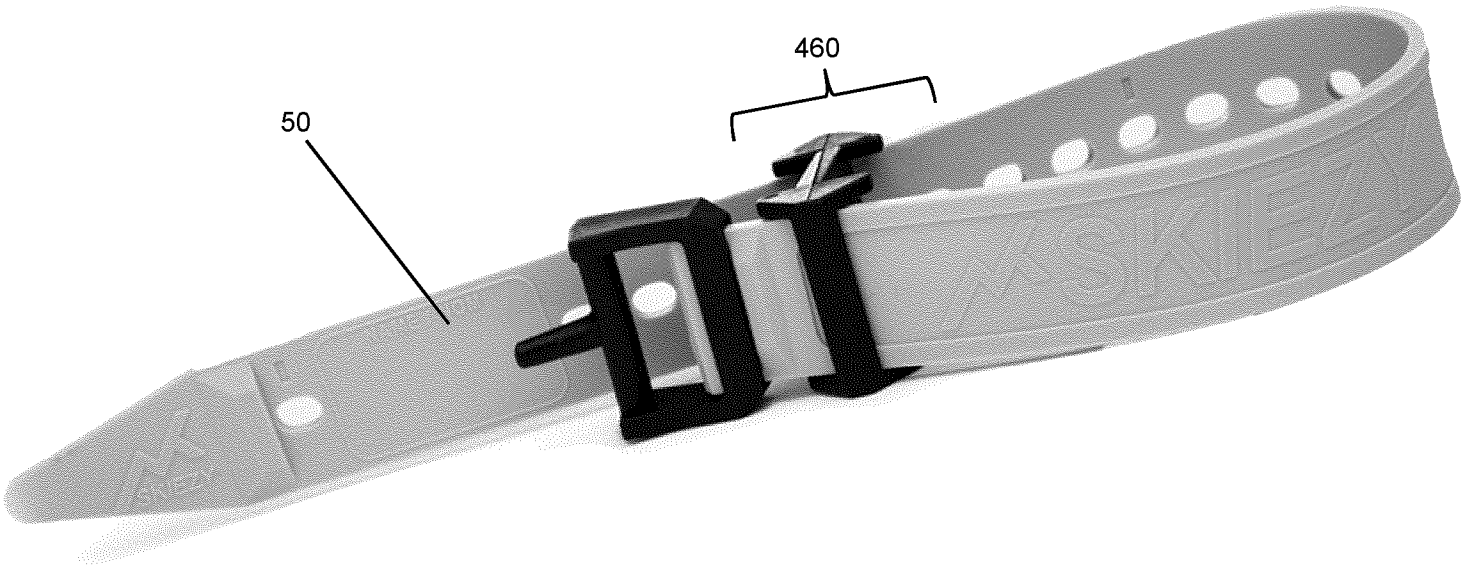
FIG. 28 is a perspective view of a ski strap assembly including a pair of the end portions shown in FIG. 23 and a skit strap.
Figure 30:
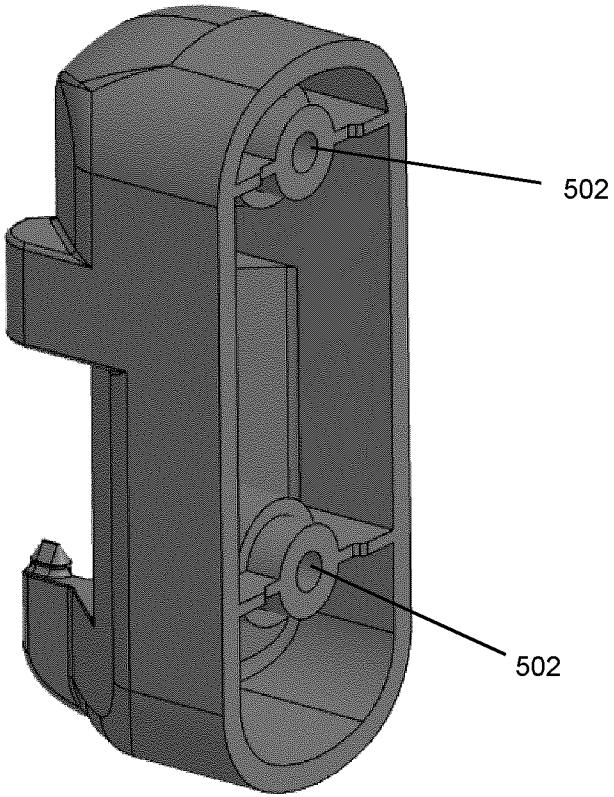
FIG. 30 is a rear perspective view of the hanging mechanism of FIG. 29.

Turning now to FIGS. 23 to 27, another implementation of an end portion 414 is shown. The end portion 414 in this example is most suited to be used with another end portion 414 in the way shown in FIG. 3, but it can be appreciated that it can also be used with a first portion 12 such as that exemplified above. In this implementation, the end portion 414 includes an inner tab 444 that includes three distinct wedge portions, namely an upper wedge 444*a*, a lower wedge 444*b*, and a central wedge 444*c*. The wedges 444*a*-444*c* provide an overall tapered shape to provide the same functionality as that described above, but reduces the overall material used and surface area that could potentially contact the skis during assembly, and creates an interface mechanism to enable a first end portion 414 to be secured to a second end portion, as shown in FIG. 28. Referring first to FIG. 23, the end portion 414 includes an outer block 440 similar to the other embodiments described above. However, in this implementation, the outer block 440 is beveled 448 on opposite sides to create a triangular or arrow shape terminating at a tip 446. The tip 446 encourages alignment with a landing area of a mounting mechanism 500 shown in FIG. 29 and described in greater detail below. FIG. 23 illustrates that a slot 442 is provided in the same way as, for example, the embodiment shown in FIG. 3.

Figure 24:
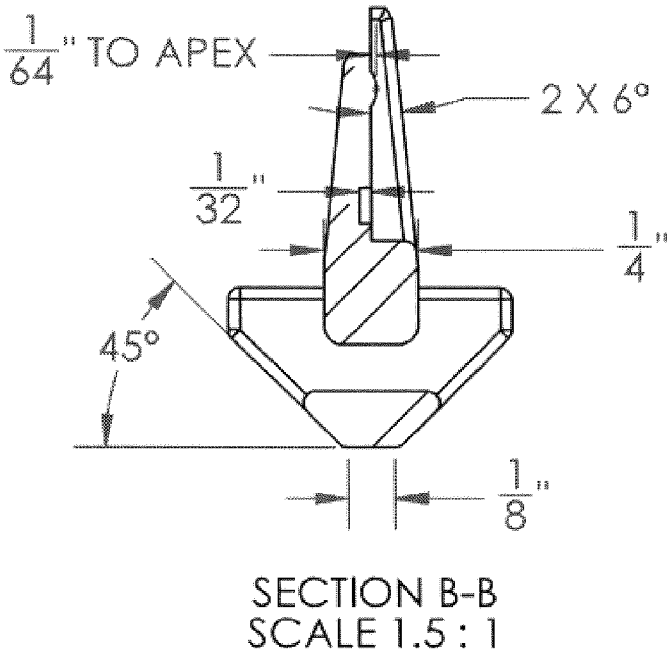
FIG. 24 is a cross-sectional view of the end portion of FIG. 25 along line B-B.
Figure 26:
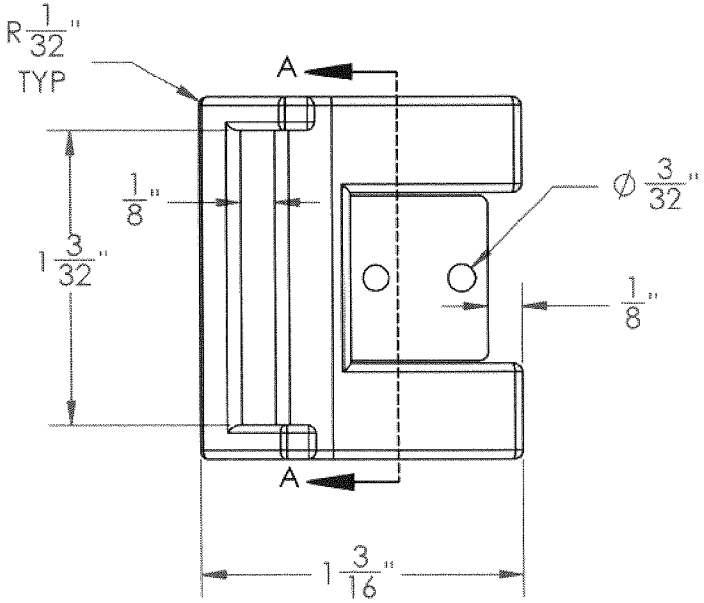
FIG. 26 is a side view of the end portion of FIG. 23.
Figure 25:
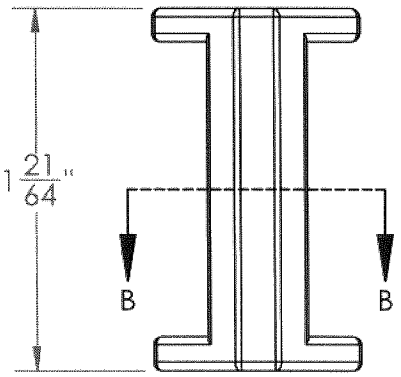
FIG. 25 is a front view of the end portion of FIG. 23.

FIGS. 24, 25, and 26 provide additional views and example dimensions that are provided for illustrative purposes only. As can be seen in FIG. 27, an offset between the central wedge 444*c* and the upper and lower wedges 444*a*, 444*b* create voids 450 at both ends of the end portion 414. As explained in greater detail below, it has been recognized that these voids 450 also enable a ski strap assembly that includes a pair of the end portions 414 and a ski strap 50 (see also FIG. 28) to be hung on a suitably configured hanging mechanism 500 described below. The presence of voids 450 at either end also enables the end portion 414 to be installed in either orientation and furthermore enables the skis to be hung with the tips up or tips down.

Figure 29:
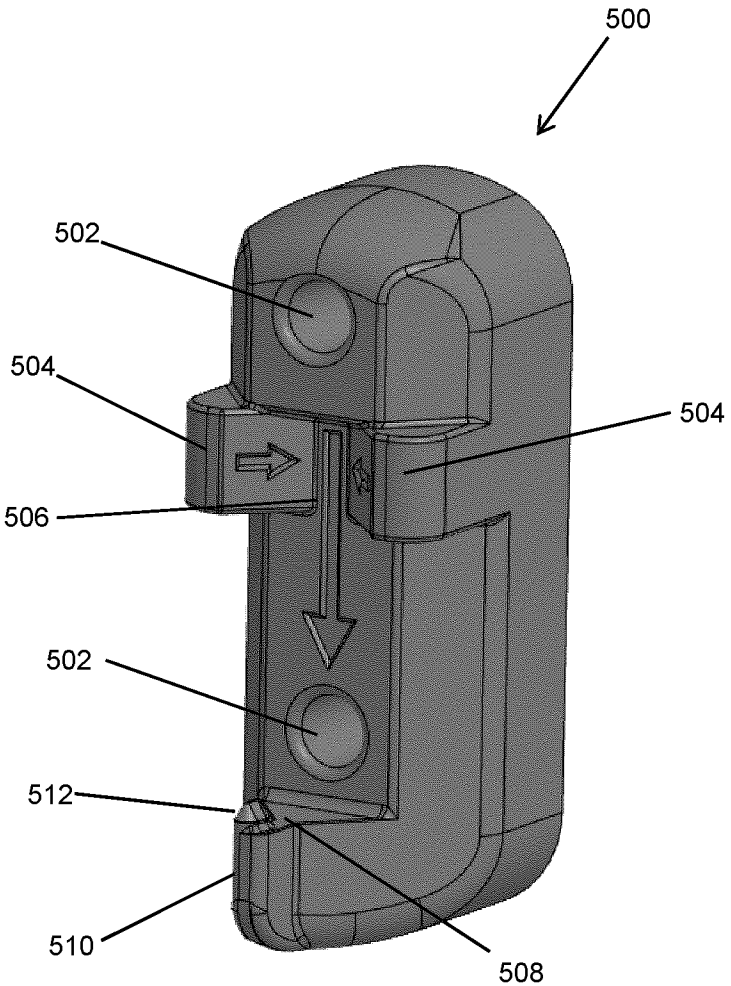
FIG. 29 is a front perspective view of a hanging mechanism configured to be used with the end portion of FIG. 23.

A hanging mechanism 500 is shown by way of example in FIGS. 29 to 34. Beginning with FIGS. 29 and 30, the hanging mechanism 500 can be constructed in a unitary body that includes a pair of passages 502 to permit the hanging mechanism to be secured to a wall, e.g., by way of screws and wall anchors as discussed above. The hanging mechanism 500 includes a pair of locating wings 504 that slope inwardly towards a landing channel 506. As illustrated in FIG. 29, the wings 504 and landing channel 506 can optionally include arrow indicia to instruct a user regarding the landing mechanism. The hanging mechanism 500 also includes a lower platform 508 for receiving an end portion 414 when secured in a ski strap assembly, in order to hang the skis S1, S2 on a wall or other substrate. It can be appreciated that a lower bumper (not shown) can also be provided in spaced relationship to the hanging mechanism 500 to maintain a substantially upright positioning of the skis S1, S2 when hung, as well as to protect the wall or substrate, provide a basin to catch dripping water to protect a baseboard, etc.

The platform 508 includes an offset arm 510 that positions an upstanding pin 512 off-center with respect to the landing channel 506. In this way, the pin 512 can be positioned in alignment with a void 450 of an end portion 414 being hung. This offset alignment is shown in FIGS. 31 and 32. FIGS. 31-34 provide additional views and example dimensions that are provided for illustrative purposes only. What can be appreciated from these views is that the platform 508 and landing area, as well as the overall contours of the hanging mechanism 500 permit rotational movement of a pair of skis S1, S2 relative to the hanging mechanism 500 when a ski strap assembly is hung on the hanging mechanism 500. This accommodation inhibits the assembly from being dislodged from the hanging mechanism 500 if bumped or jostled. To that end, the pin 512 is positioned on the arm 510 at a distance that is sufficient to enable such rotation without the end portion 414 and its outer block 440 being inhibited by the landing area beneath the wings 504. The ski strap 50 and its inherent resilience also allows the assembly to stretch if twisted when mounting on the hanging mechanism 500 thus further permitting inadvertent movements and possible rough handling without the assembly coming dislodged.

Figure 36:
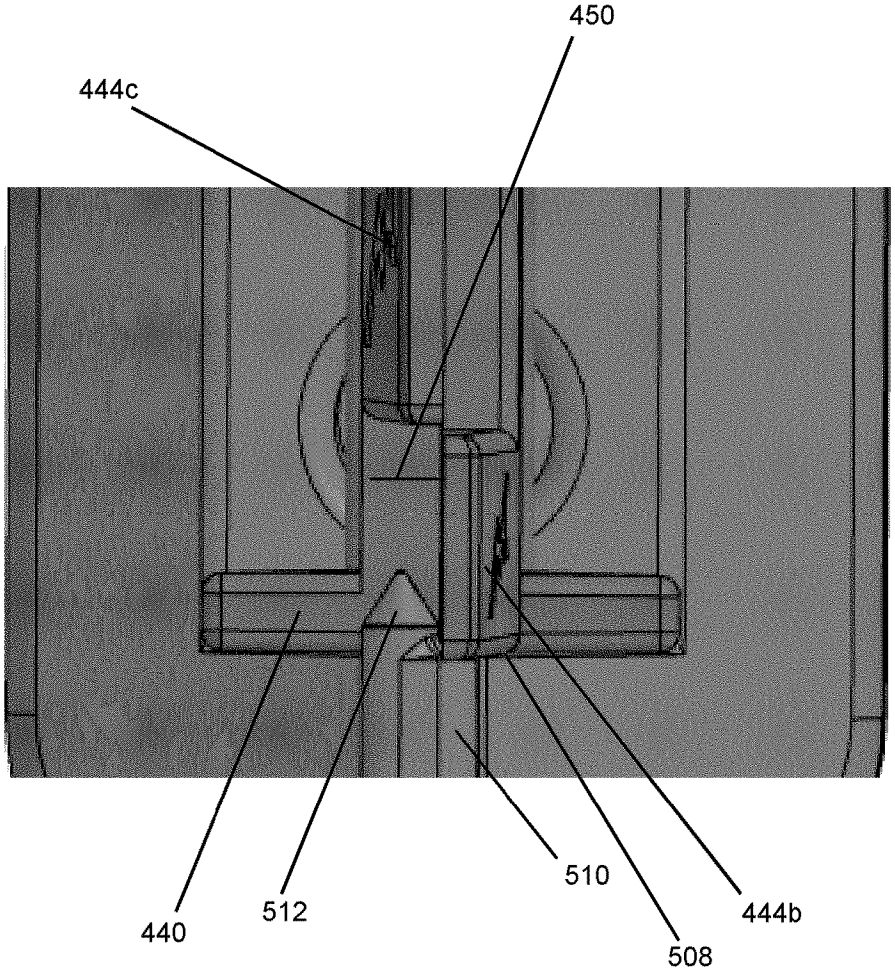
FIG. 36 is an enlarged front view of a post of the hanging mechanism relative to the end portion.
Figure 35:
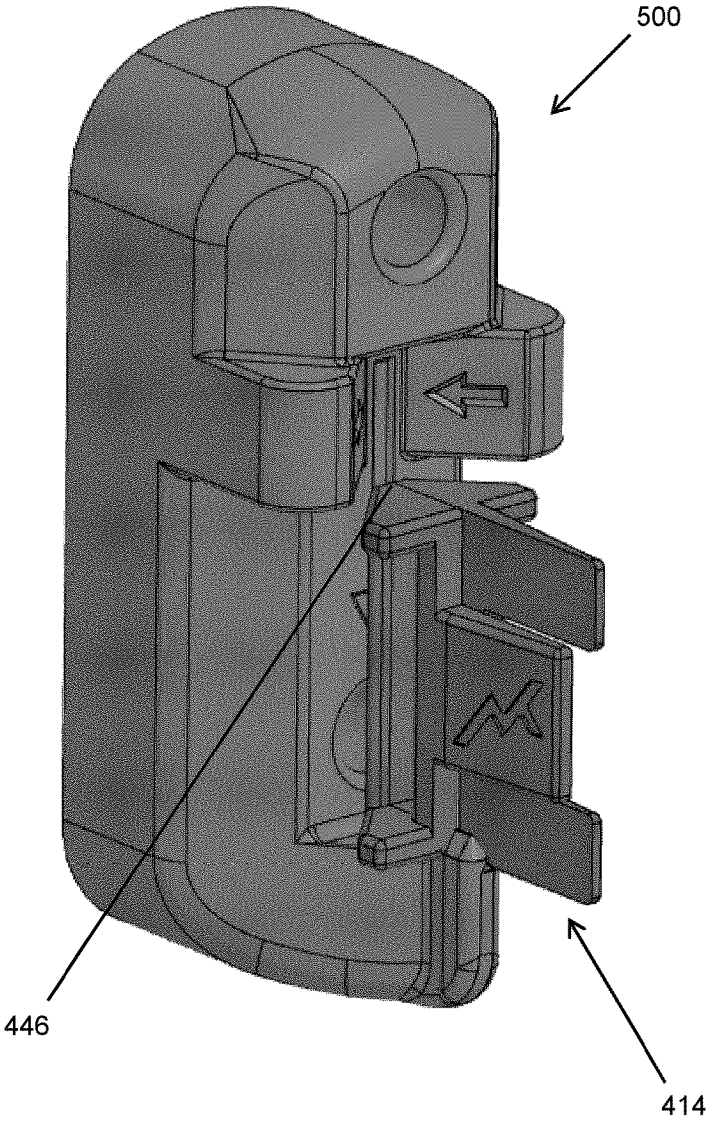
FIG. 35 is a front perspective view of the end portion of FIG. 23 seated on the hanging mechanism of FIG. 29.
Figure 38:
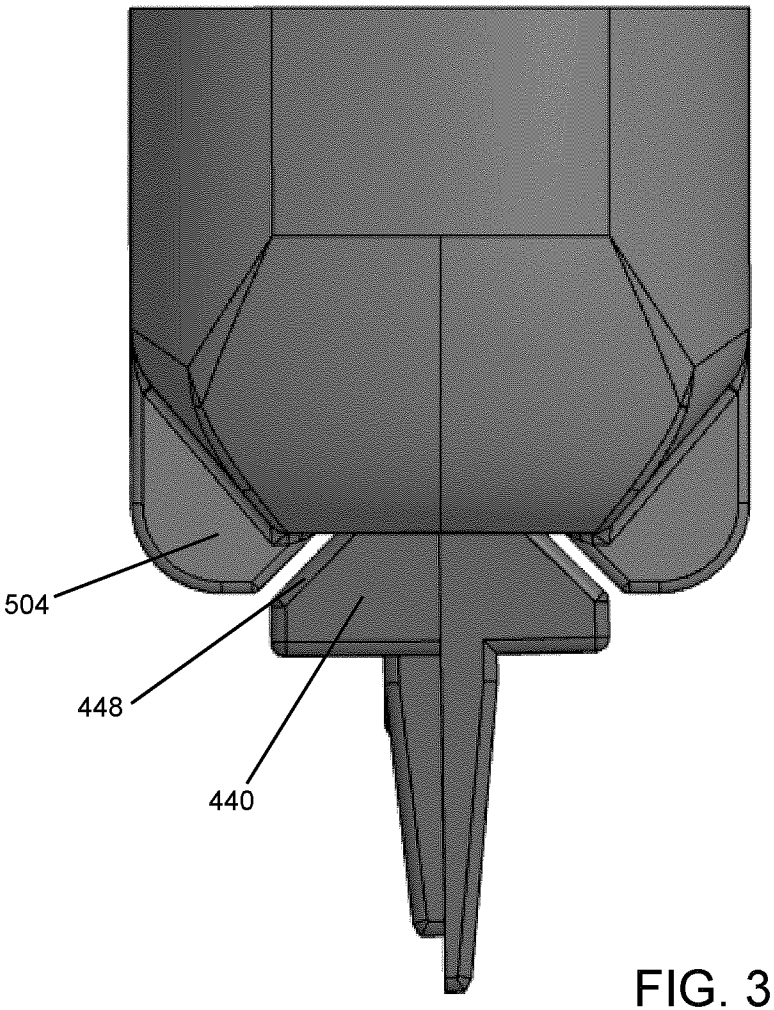
FIG. 38 is a top plan view of the end portion of FIG. 23 seated on the hanging mechanism of FIG. 29.
Figure 37:
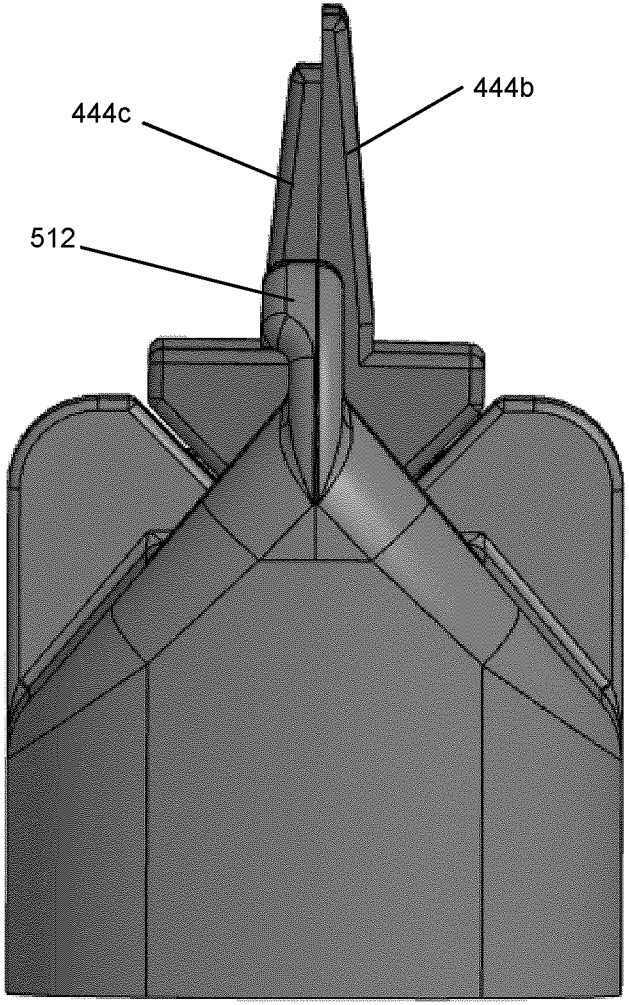
FIG. 37 is a bottom plan view of the end portion of FIG. 23 seated on the hanging mechanism of FIG. 29.

FIGS. 35 to 39 illustrate an end portion 414 mounted on a hanging mechanism 500 in isolation to illustrate the relative positioning of the pin 512 and the void 450, best seen in FIG. 36. FIGS. 35 and 36 illustrate the end portion 414 seated on the platform 508 with the arm 510 placing the pin 512 in alignment with the void 450. Referring to FIGS. 35 and 39, it can be seen that the bevels 448 of the outer block 448 are substantially similar to the sloping faces of the wings 504 to encourage the end portion 414 being received with the tip 446 adjacent the landing channel 506 to in turn encourage alignment of the pin 512 and the void 450 as seen in FIGS. 36 and 37. As also best seen in FIG. 36, the pin 512 can include a taper or otherwise be pointed or angled to minimize the surface area that could come into contact with the skis S1, S2, further creating a "no touch" or "minimum touch" assembly.

Referring again to FIG. 34, it can be appreciated that the overall depth of the hanging mechanism 500 can be chosen as illustrated to have the skis S1, S2 sufficiently offset from the wall or other substrate on which they are being hung. This reduces the potential damage to the wall or substrate and provides a gap for a user to fit their hands to retrieve the assembly.

While FIGS. 29-39 illustrate a single hanging mechanism 500 for hanging one ski strap assembly 20, it can be appreciated that a plurality of hanging mechanisms 500 can be provided in the same structure or be attached to a rail or other base in order to provide a ski hanging rack configuration.

It can be appreciated that different configurations of the devices 10, 20 can be made for Alpine versus Nordic skis, which inherently have different characteristics, such as width, thickness, and camber. This can be done by varying the length of the inners tabs 36, 44, and the length of the strap 16, particularly to accommodate the different widths.

For simplicity and clarity of illustration, where considered appropriate, reference numerals may be repeated among the figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, well-known methods, procedures and components have not been described in detail so as not to obscure the examples described herein. Also, the description is not to be considered as limiting the scope of the examples described herein.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

Although the above principles have been described with reference to certain specific examples, various modifications thereof will be apparent to those skilled in the art as outlined in the appended claims.

The invention claimed is:

1. An assembly for a ski strap comprising:

a first portion comprising a first outer block, a first inner tab extending from the first outer block such that the first outer block extends to each side of the first inner tab to permit the first inner tab to be positioned between a pair of skis, and a first retaining mechanism for a strap, the first retaining mechanism configured to position a first portion of the strap generally perpendicular to the first inner tab when the first portion of the strap is engaged with the first outer block while the strap is wrapped around the pair of skis; and a second portion comprising a second outer block, a second inner tab extending from the second outer block such that the second outer block extends to each side of the second inner tab to permit the second inner tab to be positioned between the pair of skis opposite the first inner tab, and a second retaining mechanism for the strap, the second retaining mechanism configured to position a second portion of the strap generally perpendicular to the second inner tab when the second portion of the strap is engaged with the second outer block while the strap is wrapped around the pair of skis.

2. The assembly of claim 1, further comprising the ski strap.

3. The assembly of claim 2, wherein the ski strap comprises a length extending from a buckle, the buckle permitting the length to be fed therethrough to tighten the skis against the first and second portions by looping the length around a portion of the buckle.

4. The assembly of claim 3, wherein the buckle further comprises an angled tooth for securing the length of the strap to itself, using one of a plurality of holes along the length.

5. The assembly of claim 1, wherein at least one of the first inner tab and the second inner tab is tapered.

6. The assembly of claim 1, wherein at least one of the first outer block and the second outer block further comprises a recessed area on at least one side of the respective inner tab to accommodate at least a portion of an edge protruding from a respective one of the skis.

7. The assembly of claim 6, comprising a recessed area on both sides of the respective inner tab to accommodate at least a portion of an edge protruding from each of the skis.

8. The assembly of claim 7, wherein both the first outer block and the second outer block comprise the recessed area on both sides of the respective inner tab.

9. The assembly of claim 6, wherein the recessed area is formed from a bevel extending into the at least one of the first outer block and the second outer block.

10. The assembly of claim 6, wherein the recessed area is formed from a notch extending into the at least one of the first outer block and the second outer block.

11. The assembly of claim 1, wherein at least one of the first portion and the second portion comprises an electrically inert material.

12. The assembly of claim 11, wherein the electrically inert material comprises a glass-filled nylon.

13. The assembly of claim 1, wherein at least one of the first inner tab and the second inner tab comprises multiple offset portions to create at least one void for interfacing with a hanging mechanism.

14. The assembly of claim 13, wherein the multiple offset portions comprise an upper wedge, a lower wedge and a central wedge creating an upper void and a lower void.

15. The assembly of claim 1, wherein at least one of the first outer block and the second outer block is tapered for interfacing with a hanging mechanism.

16. A ski strap device comprising:

a ski strap; and the assembly of claim 1.

17. The ski strap device of claim 16, further comprising a hanging mechanism, the hanging mechanism comprising a platform extending from a body for supporting the assembly, the platform comprising a pin extending upwardly therefrom and positioned to be in alignment with a void on at least one of the first and second portions of the assembly to have the assembly rest on the platform to hang the pair of skis.

18. A hanging device for skis, comprising:

a first portion comprising a first outer block, a first inner tab extending from the first outer block such that the first outer block extends to each side of the first inner tab to permit the first inner tab to be positioned between a pair of skis, a first retaining mechanism for a strap, and a hanging mechanism extending in a direction opposite that of the first inner tab, for hanging the pair of skis when secured by the strap; and a second portion comprising a second outer block, a second inner tab extending from the second outer block such that the second outer block extends to each side of the second inner tab to permit the second inner tab to be positioned between the pair of skis opposite the first inner tab, and a second retaining mechanism for the strap.

19. A ski strap assembly comprising:

a ski strap; and the hanging device of claim 18.

20. The hanging device of claim 18, wherein at least one of the first inner tab and the second inner tab is tapered.

* * * * *